US010765594B2

(12) United States Patent
Sanchez

(10) Patent No.: US 10,765,594 B2
(45) Date of Patent: Sep. 8, 2020

(54) MASSAGE FOAM ROLLER APPARATUS AND SYSTEM

(71) Applicant: Michael A. Sanchez, Pleasanton, CA (US)

(72) Inventor: Michael A. Sanchez, Pleasanton, CA (US)

(73) Assignee: Michael A. Sanchez, Pleasanton, CA (US)

( * ) Notice: Subject to any disclaimer, the term of this patent is extended or adjusted under 35 U.S.C. 154(b) by 795 days.

(21) Appl. No.: 14/664,806

(22) Filed: Mar. 20, 2015

(65) Prior Publication Data

US 2017/0071817 A1 Mar. 16, 2017

Related U.S. Application Data

(60) Provisional application No. 61/968,344, filed on Mar. 20, 2014.

(51) Int. Cl.
*A61H 15/00* (2006.01)

(52) U.S. Cl.
CPC ..... *A61H 15/00* (2013.01); *A61H 15/0092* (2013.01); *A61H 2015/0014* (2013.01);
(Continued)

(58) Field of Classification Search
CPC ..... A61H 15/00; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 15/0078; A61H 15/0085; A61H 15/0092; A61H 15/02; A47J 41/0011; B65D 81/3876; B65D 11/02; B65D 43/0206; B65D 39/0088; A63B 71/0036; A45C 15/00; A45C 9/00; A45C 13/30; A45C 13/008; A45C 13/123; A45C 2009/007
(Continued)

(56) References Cited

U.S. PATENT DOCUMENTS 1,882,370 A * 10/1932 Schroeder ..... A61H 15/0092 601/19
2,273,710 A * 2/1942 Klaes ..... A61H 15/0092 601/119
(Continued)

*Primary Examiner* — Tu A Vo

(57) ABSTRACT

Therapeutic roller apparatus including at least two easily interchangeable elongated, semi-cylindrical component assemblies, each formed by a rigid substrate component having a concave inner surface and a convex outer surface, and a resilient pad component affixed to and covering the outer surface of the rigid substrate part. The side edges of the component assemblies are adapted to mate together to form a cylindrical roller body having a first outer diameter. The roller body ends are provided with first latch elements. A pair of cylindrical end caps, each having an outer diameter greater than the roller's first outer diameter, and an inner diameter adapted to mate with and capture an end of the assembled roller body. The end caps include second latch elements adapted to lockingly engage the first latch elements and secure the entire assembly together. In use, all user weight applied to the roller body is transferred to the end caps.

2 Claims, 24 Drawing Sheets

(52) U.S. Cl.
CPC ..... *A61H 2201/0157* (2013.01); *A61H 2201/1253* (2013.01); *A61H 2201/1685* (2013.01); *A61H 2201/1695* (2013.01)

(58) Field of Classification Search
USPC ..... D24/211–215
See application file for complete search history.

(56) References Cited

U.S. PATENT DOCUMENTS 2,448,797 A * 9/1948 Gustlin ..... A61H 15/00 601/19
2,546,095 A * 3/1951 Gustlin ..... A61H 15/02 601/121
2,943,621 A * 7/1960 Phillips ..... A61H 23/0218 5/636
5,143,056 A * 9/1992 Yih-Jong ..... A61H 15/00 601/118
5,335,809 A * 8/1994 Toida ..... A47J 41/0011 220/23.88
5,425,194 A * 6/1995 Miller ..... A01K 97/08 206/315.11
5,554,102 A * 9/1996 Chiou ..... A61H 15/0092 601/118
5,637,065 A * 6/1997 Chang ..... A63B 23/14 482/1
6,398,694 B1 * 6/2002 Bountourakis ..... A63B 21/015 482/109
7,223,251 B1 * 5/2007 Cassidy Phillips ..... A61H 15/0092 601/118
7,387,599 B1 * 6/2008 Hsu ..... A61H 15/0092 482/122
8,556,837 B1 * 10/2013 Poirier ..... A61H 15/00 601/46
8,926,482 B2 * 1/2015 Miller, Jr. ..... A63B 22/20 482/132
8,951,172 B2 * 2/2015 Marcus ..... A63B 21/075 482/106
2005/0070827 A1 * 3/2005 Lee ..... A61H 23/0263 601/57
2006/0241537 A1 * 10/2006 Liu ..... A61H 15/0092 601/118
2007/0129654 A1 * 6/2007 Anderson, Jr. ..... A61H 15/00 601/119
2010/0113992 A1 * 5/2010 Godfrey ..... A61H 15/0078 601/70
2012/0065557 A1 * 3/2012 Phillips ..... A61H 15/0092 601/99
2012/0172771 A1 * 7/2012 Jian ..... A61H 15/0092 601/46
2012/0309599 A1 * 12/2012 Miller, Jr. ..... A63B 22/20 482/139
2012/0310125 A1 * 12/2012 Hall ..... A61H 15/0085 601/120
2013/0281892 A1 * 10/2013 Godfrey ..... A61H 15/0078 601/15
2013/0310234 A1 * 11/2013 Miller, Jr. ..... A63B 22/20 482/139
2014/0012168 A1 * 1/2014 Carlson ..... A61H 15/0092 601/134
2014/0128786 A1 * 5/2014 Ross ..... A61H 15/0092 601/118
2015/0005146 A1 * 1/2015 Chen ..... A63B 21/00047 482/142
2015/0209220 A1 * 7/2015 Lin ..... A61H 15/0092 601/119

* cited by examiner

MASSAGE FOAM ROLLER APPARATUS AND SYSTEM

This application claims priority to my U.S. Provisional Patent Application No. 61/968,344 filed on Mar. 20, 2014 and entitled "Improved Massage Foam Roller Apparatus and System". The entire content of the application is expressly incorporated herein by reference.

BACKGROUND OF THE INVENTION

The present invention relates generally to therapeutic massage apparatus and more particularly to an improved therapeutic "foam" massage roller apparatus and system for use by athletes, chiropractors, personal trainers, massage therapists and physical therapists to relax various body muscles.

The therapeutic activity known as foam rolling is a self-myofascial release (SMR) technique that is used to relax overactive or tight muscles and is a form of stretching that utilizes the concept of autogenic inhibition to improve soft tissue extensibility, thus relaxing the muscle(s) and allowing the activation of the antagonist muscle(s). The technique can be effective for many muscles, including the gastrocnemius, latissimus dorsi, piriformis, adductors, quadriceps, hamstrings, hip flexors, thoracic spine (trapezius and rhomboids), and tensor fasciae latae (TFL) muscles, and is accomplished by rolling a resilient foam roller under each muscle group until a tender area is found, and then maintaining pressure on the tender areas (known as trigger points) for 30 to 60 seconds. While there is currently a lack of research materials relating to the actual use of foam rollers, it is widely recognized that the use of such rollers have the same effects as deep-tissue massage, of which there has been considerable research on the effects of such massage on the body, much of which can also be carried over to rolling.

The apparatus normally used for rolling usually consists of a foam cylinder or foam covered hollow core of various sizes; commonly twelve or more inches long and approximately six or so inches in diameter. However, longer foam rolls up to approximately 36 inches in length may be used for rolling over certain muscles in the back. A variety of foam roller materials (including ethylene vinyl acetate (EVA) and polyurethanes) and densities have been used, often denoted by the color of the roller.

Those new to foam rolling, or those who have particularly tight muscles or severe trigger points, often start with a softer foam roll and then move on to other roller configurations particularly suited to their therapeutic need. By performing with certain roller types and techniques, one can improve flexibility, function, performance, and reduce injuries by using his/her own body weight to roll on the round foam roll, massaging away restrictions to normal soft-tissue extensibility thereby improving recovery time.

Many types of roller devices are currently in use. However, the surface types and rigidity of such devices are not easily modifiable or changeable, and it is often the case that several different types of roller devices must be available to address multiple muscle-type therapy needs. In addition, the user of a foam roller in a gym or other public environment often has to carry with him/her sundry items like watches, keys, wallets or gym keys, etc., and has no secure place to leave them during use of the roller or rollers. Moreover, currently available rollers are usually awkward to carry thus necessitating the addition use (and expense) of a carry bag or clumsy leash or strap. In addition, there is no place to carry water and/or various drinking fluids, etc.

Currently available rollers are limited in surface patterns and density because not all patterns offer smooth rolling. Patterns with wide gaps are not possible because the roller will get stuck and cause the user to strain to move the roller back and forth. Rollers with patterns and heavy density suffer from the same challenges.

It is therefore an objective of the present invention to provide an improved foam roller apparatus the design and configuration of which is based on sound medical/scientific concepts.

Another objective, of the present invention is to provide a foam roller apparatus that can be conveniently reconfigured to address particular therapeutic needs or concerns.

Still another objective of the present invention is to provide a foam roller system and apparatus that can be selectively configured to accommodate a wide range of users from beginner to advanced user.

A further objective is to provide smoother rolling on a patterned and/or high density surface by designing the roller with more height (larger diameter) at the end caps than in the roller body, thereby distributing the user's weight to the end caps and providing smooth rolling no matter what pattern or density is utilized.

Another objective is to offer improved therapeutic surfaces with novel patterns that are made possible due to the novel end cap design. These are shapes that would cause the roller to stick with traditional roller designs, where weight is not distributed on the end caps.

Yet another objective of the present invention is to provide a foam roller apparatus having easily interchangeable parts and features that can be mixed and matched to accommodate the particular needs and convenience of a wide range of users.

Briefly, an embodiment of the present invention includes a roller body comprised of at least two replaceable resilient therapeutic massage pads and an associated pad substrate adapted to be mounted on a rigid, generally tubular core element, and a pair of end caps provided to lockingly mate with and enclose the ends of the core. The interior space of the core element may be used as a storage chamber for storing sundry items. In addition, a detachable carry strap may be affixed to the end caps to accommodate transport of the device.

Another embodiment of the present invention includes a roller unit comprised of at least two replaceable resilient therapeutic massage pads mounted on corresponding substantially rigid pad substrates adapted to mate together to form a generally tubular roller body held together by a pair of end caps provided to both retain the component parts together and close the ends of the body. Preferably, the end caps are circular and of somewhat larger diameter than the roller body so that the weight of the user is transferred, or distributed, to the end caps such that the unit rolls smoothly on its supporting surface independent of the pattern or density of the massage pads.

Embodiments of the present invention are preferably of a snap-together design allowing ease of assembly as well as user convenience in change of massage surface configuration.

An important advantage of the present invention is that it provides a roller unit having replaceable foam cover pads which are readily interchangeable with other cover pads having different therapeutic massage characteristics.

Another advantage of the present invention is that it allows the use of different types of pads made of different materials having different degrees of resiliency or hardness and/or surface contours.

Still another advantage of the present invention is that it provides a roller assembly that can be used with or without the included end caps.

Yet another advantage of the present invention is that it provides a storage facility for storing other items the user might have in his/her possession at the time and place of use of the roller.

A still further advantage of the present invention is that it allows the user to select whether he/she wants the rolling engagement with the supporting surface to be influenced by or independent of the therapeutic pad characteristics.

These and other objectives and advantages of the present invention will no doubt become apparent to those skilled in the art after a reading of the following detailed disclosure of the various alternative embodiments illustrated in the several figures of the drawing.

IN THE DRAWING

Figure 18:
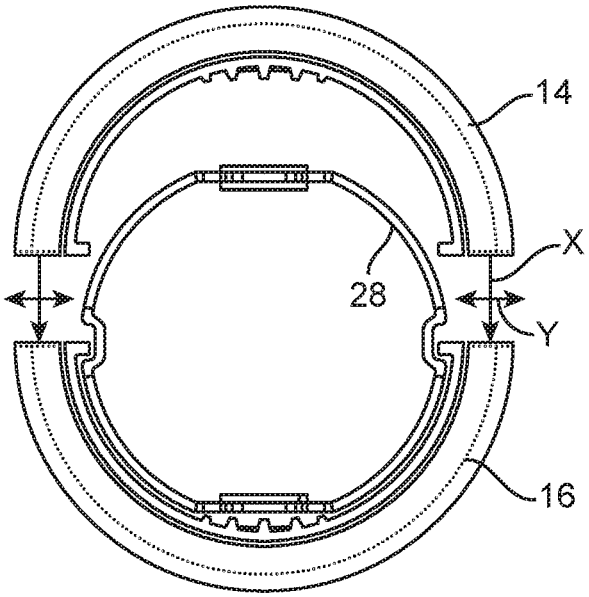
Figure 19:
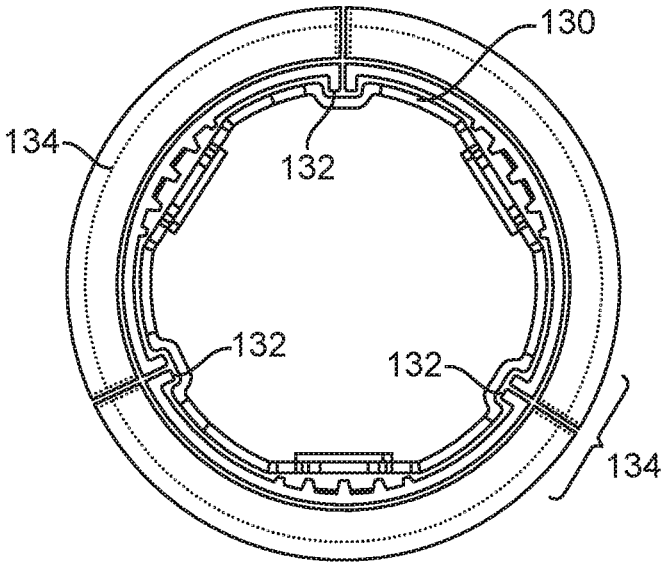

FIG. 18 is a transverse cross-sectional view illustrating an alternative method of attachment of the cover pad/substrate subassemblies or modules in accordance with the present invention; and FIG. 19 is a transverse cross-sectional view illustrating an alternative embodiment of the present invention in which more than two cover pad/substrate subassemblies are mounted on an alternatively configured core.

Figure 20:
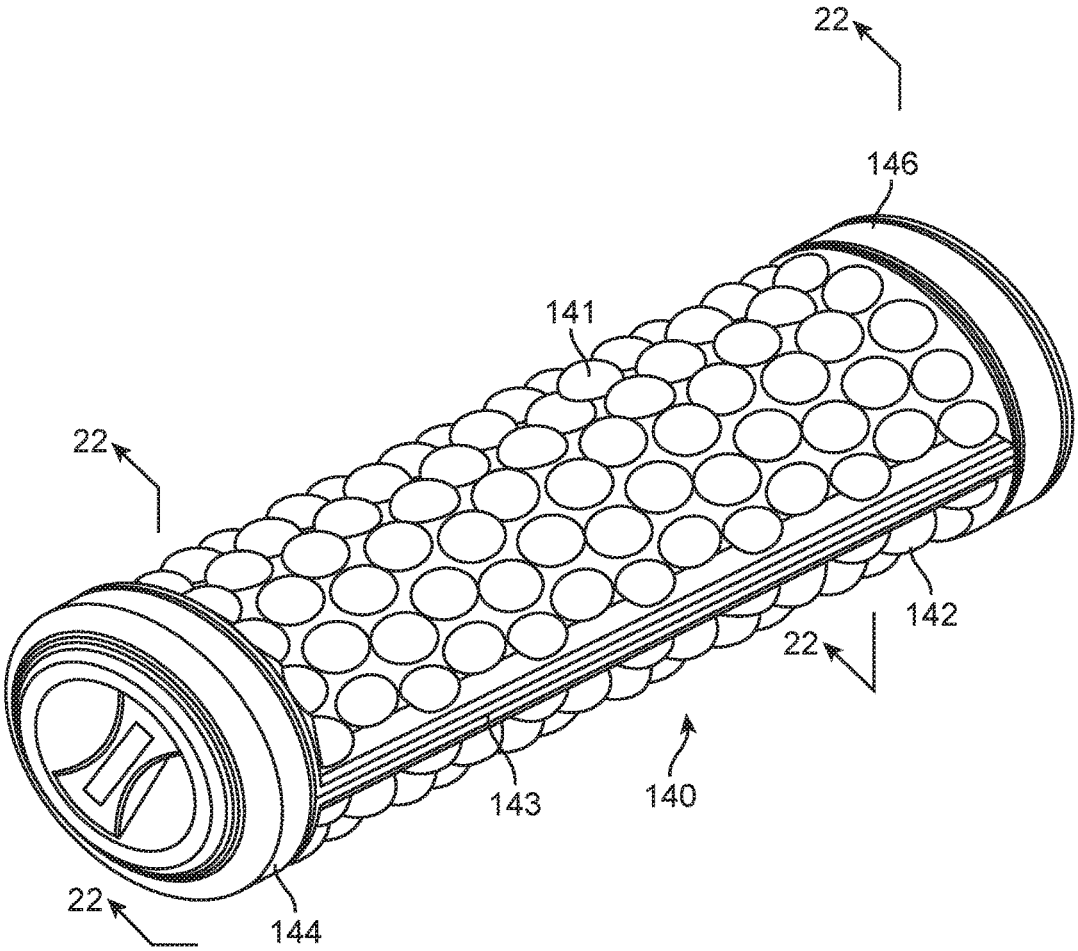
Figure 21:
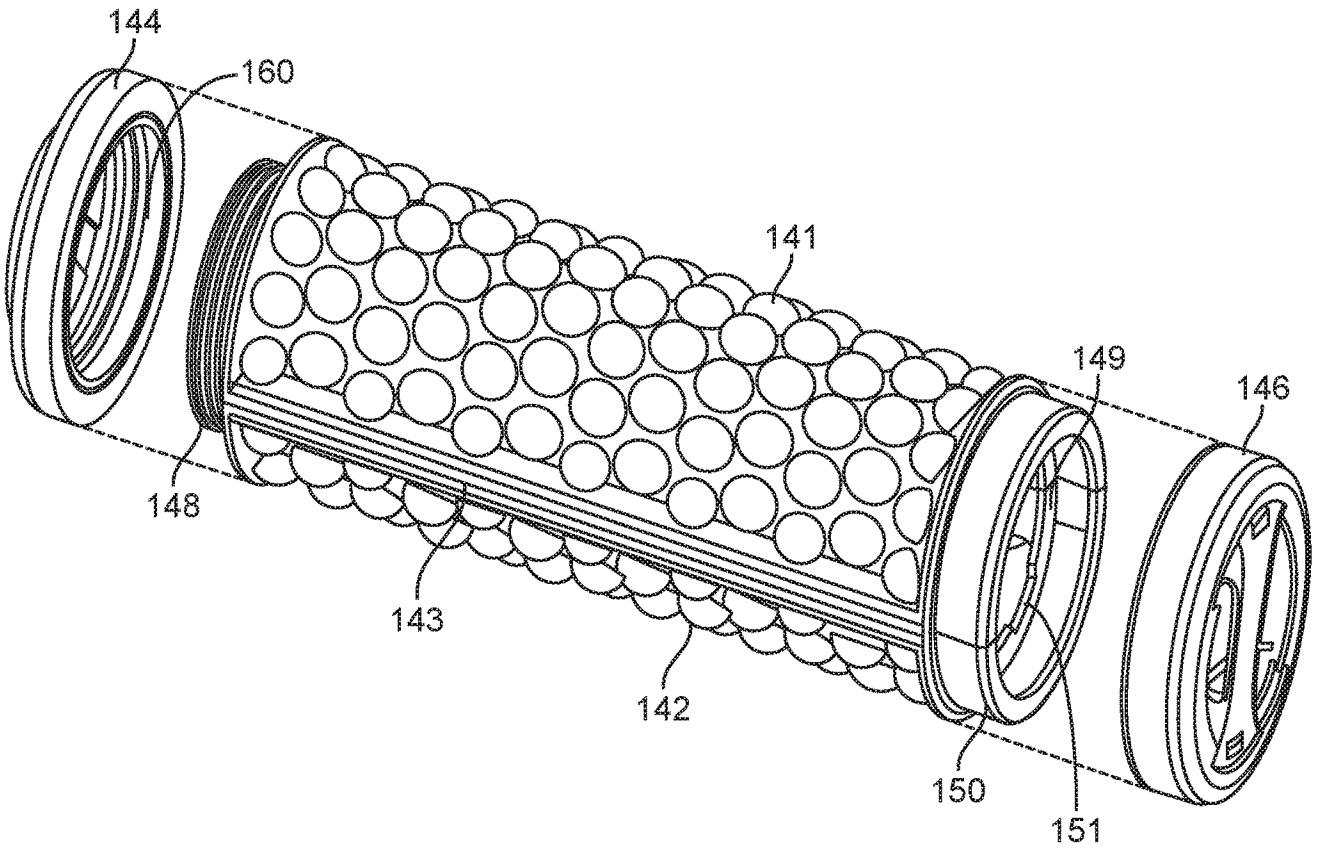
Figure 22:
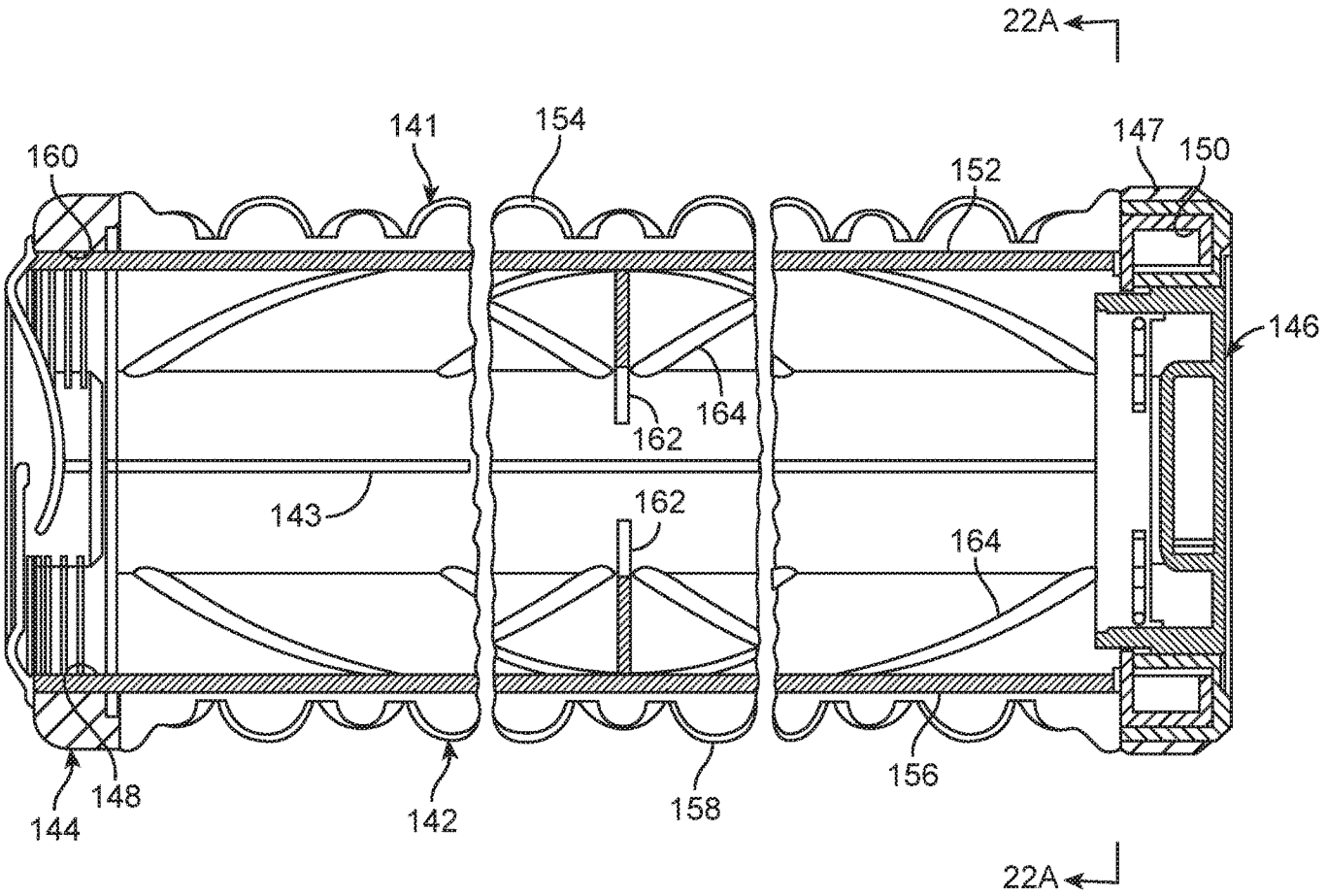
Figure 22A:
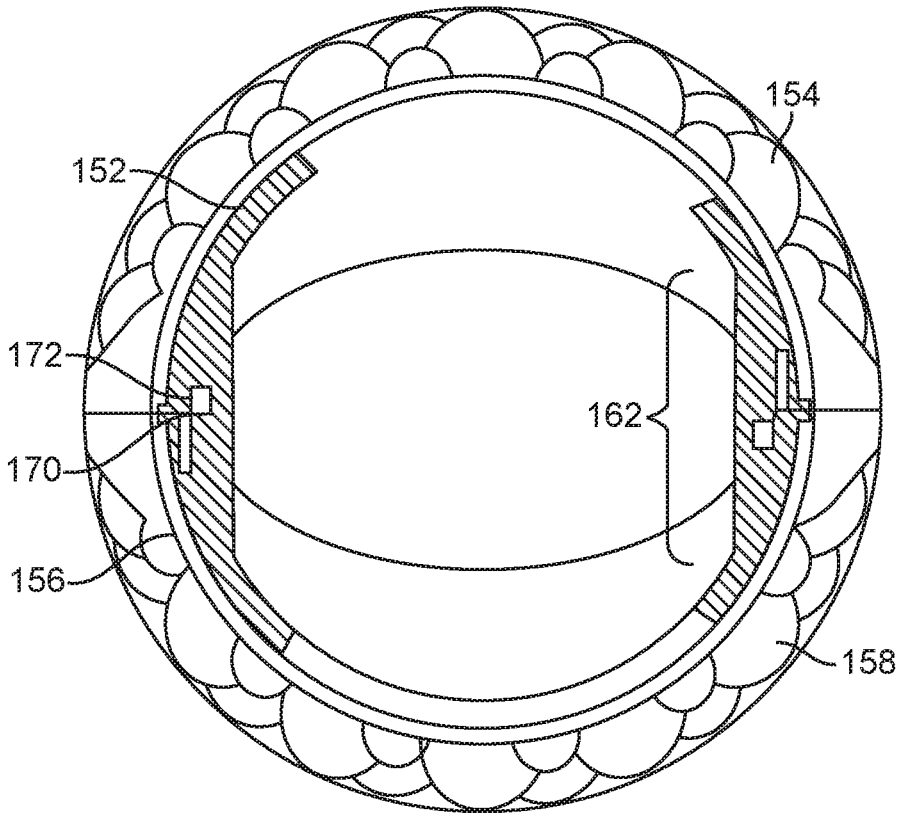
Figure 23:
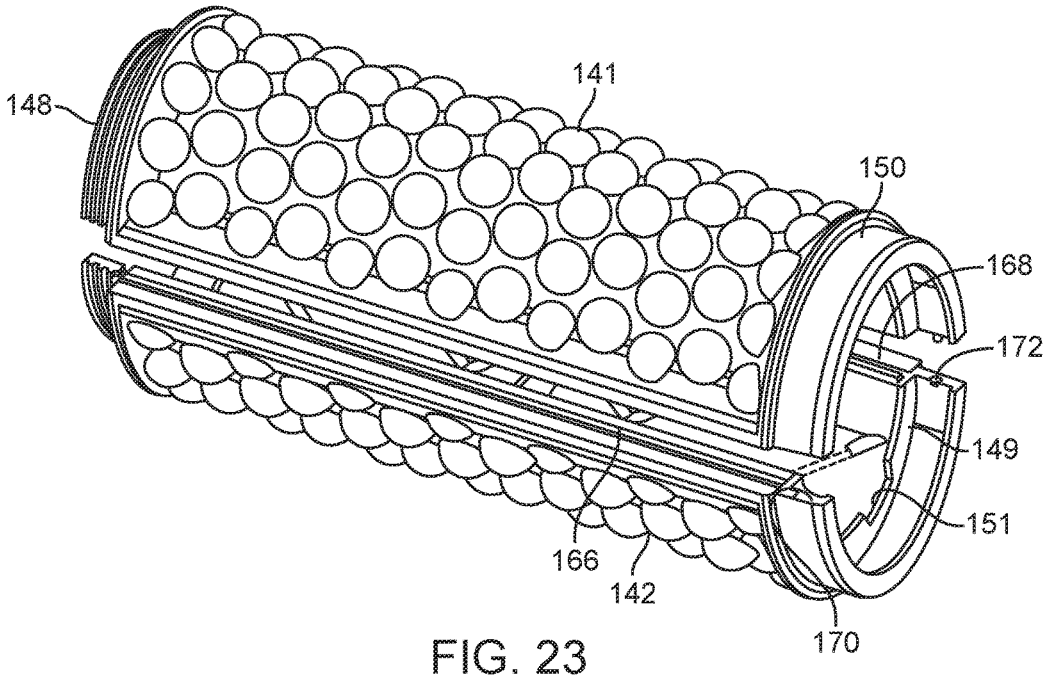
Figure 24:
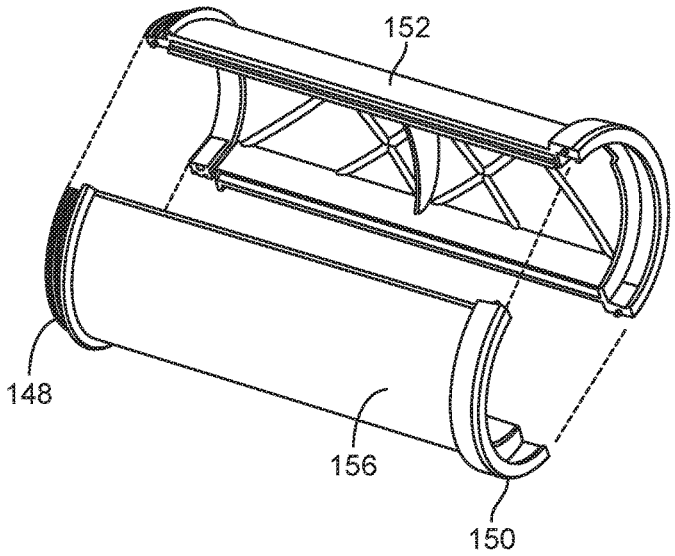
Figure 25:
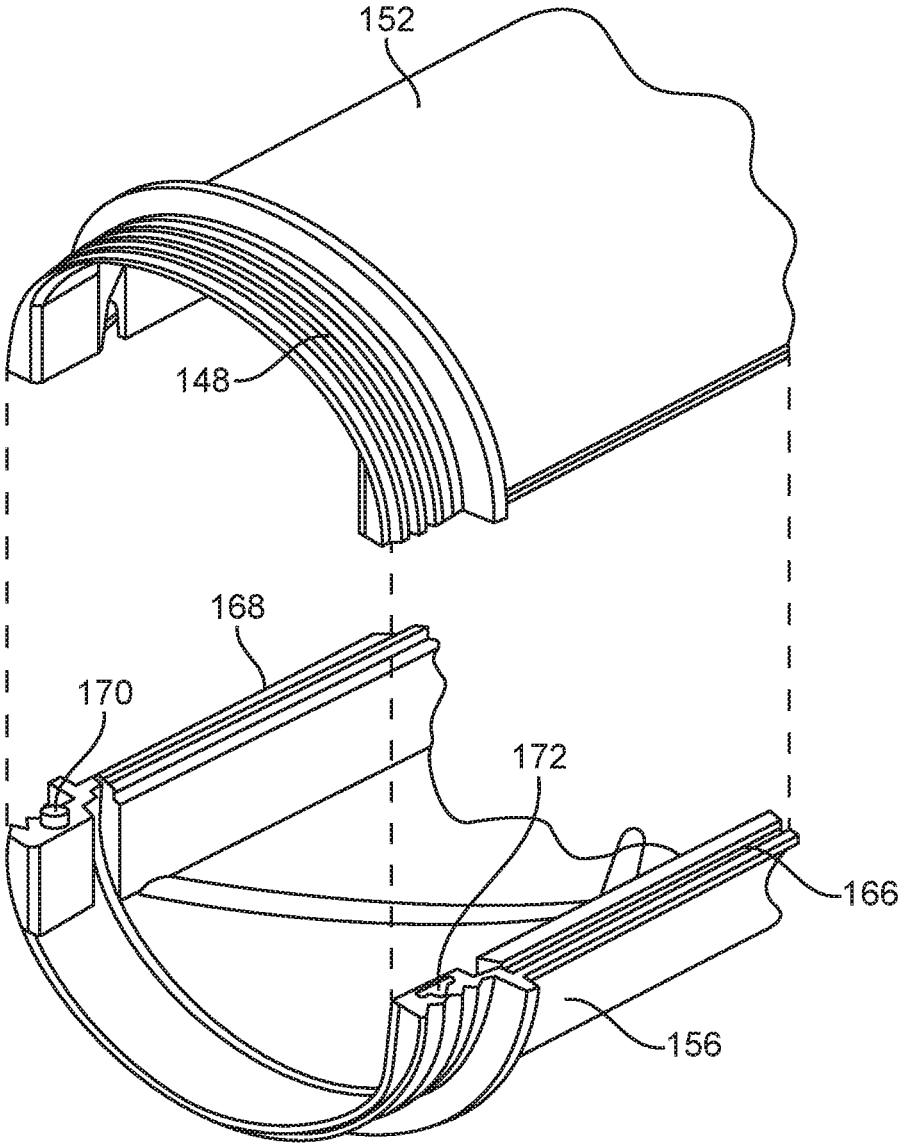
Figure 26:
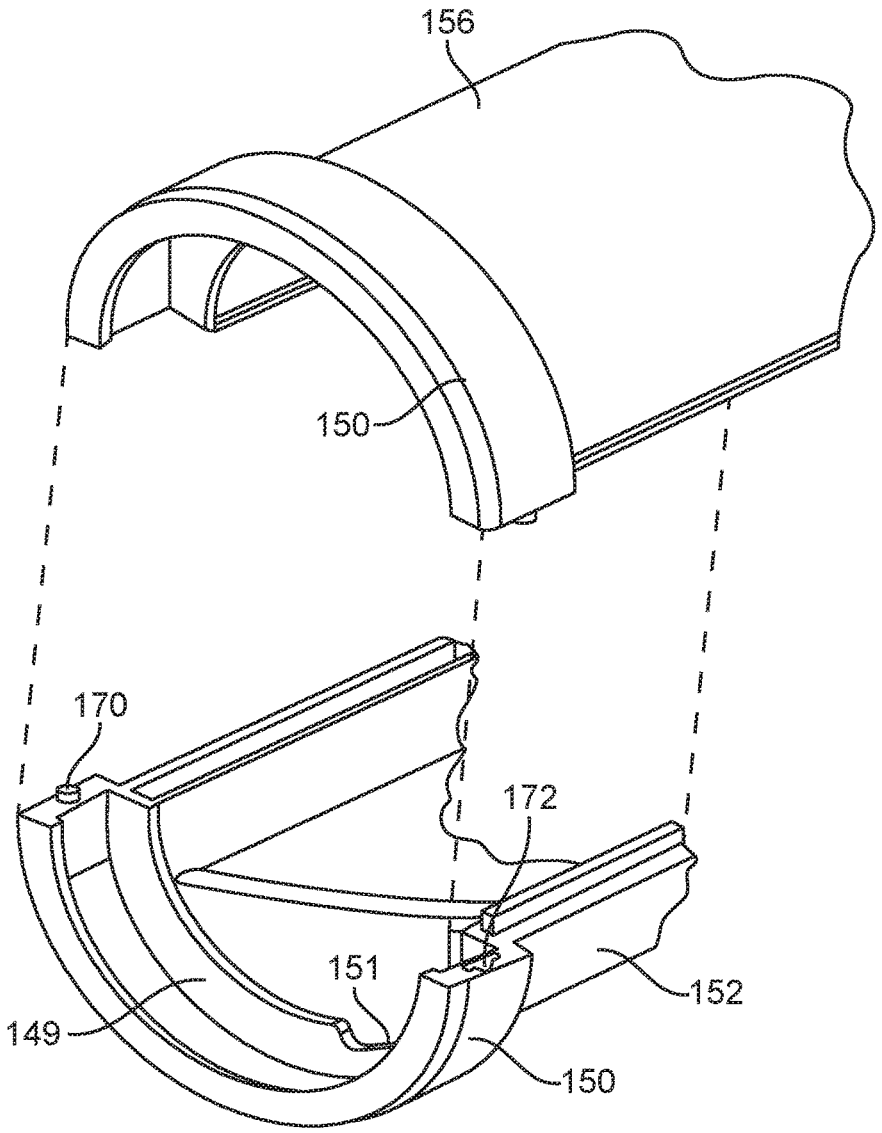
Figure 27B:
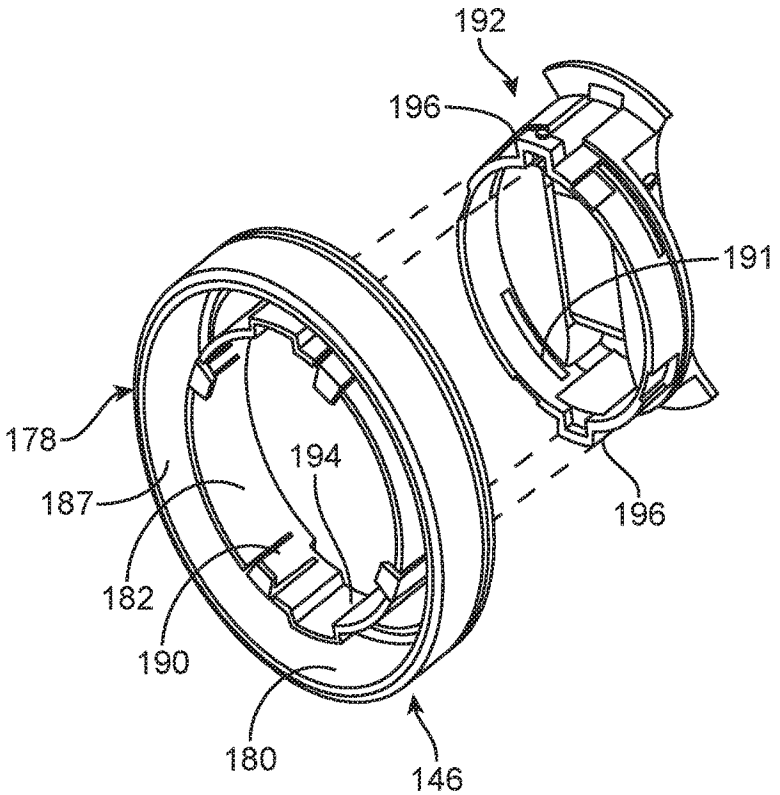
Figure 27A:
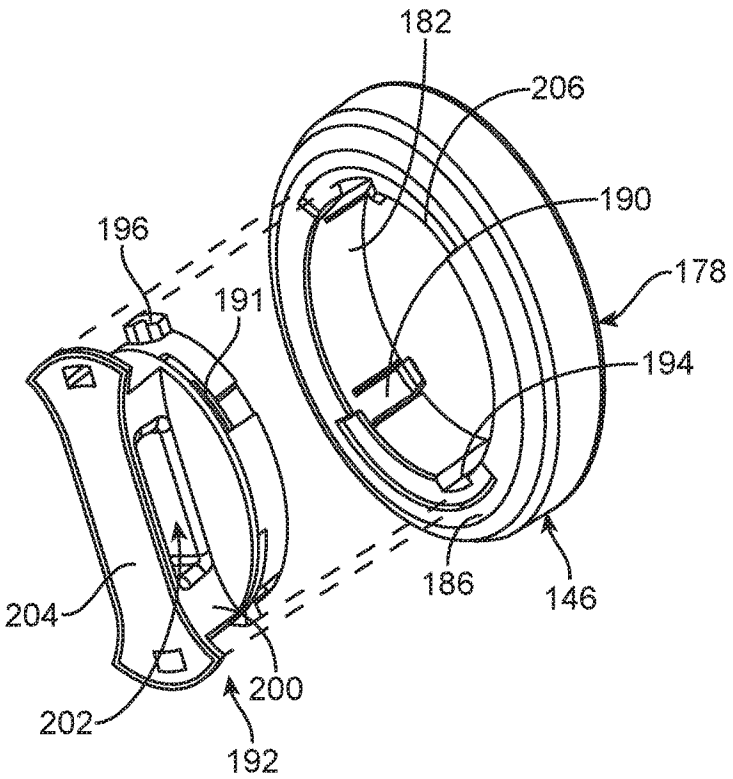
Figure 27C:
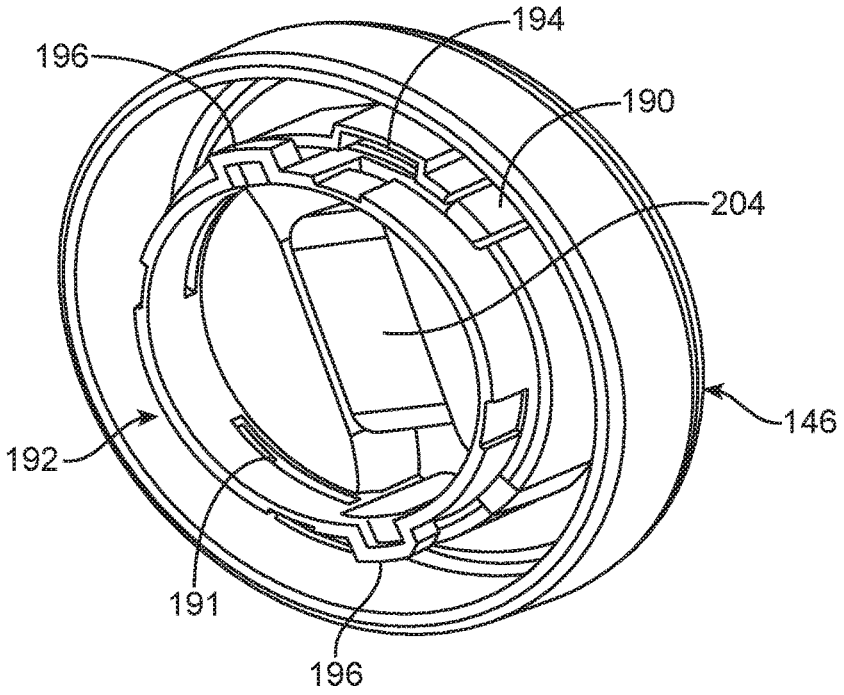
Figure 27D:
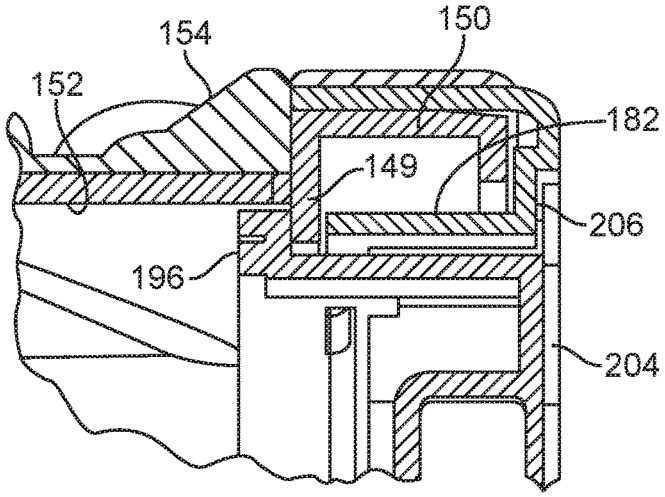
Figure 28A:
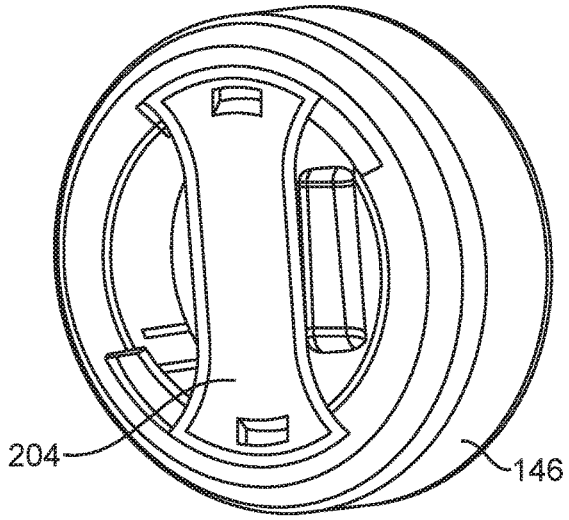
Figure 28B:
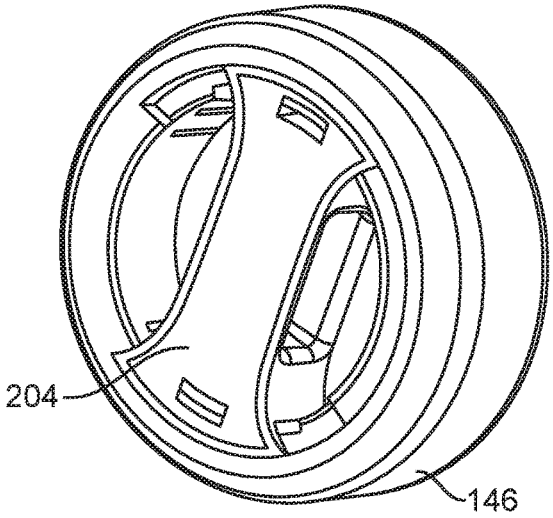
Figure 29A:
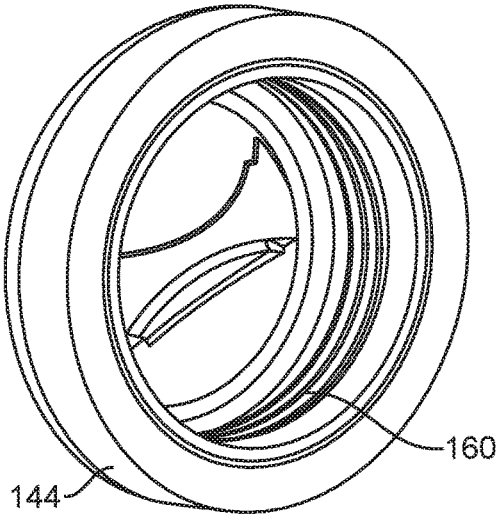
Figure 29B:
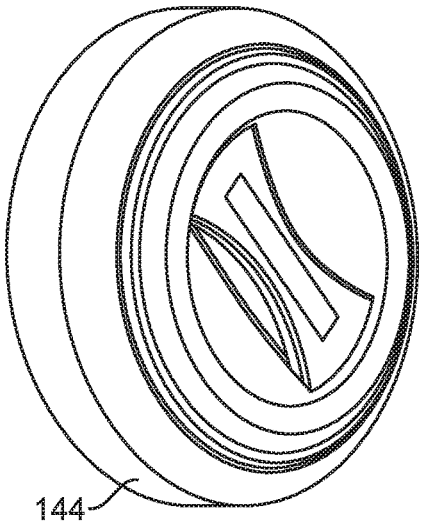
Figure 30:
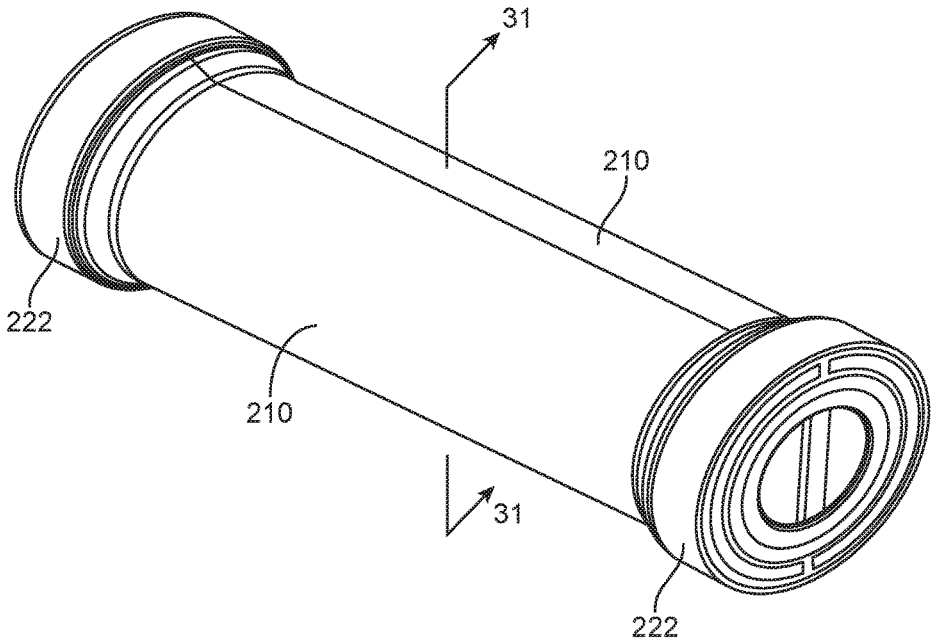
Figure 31:
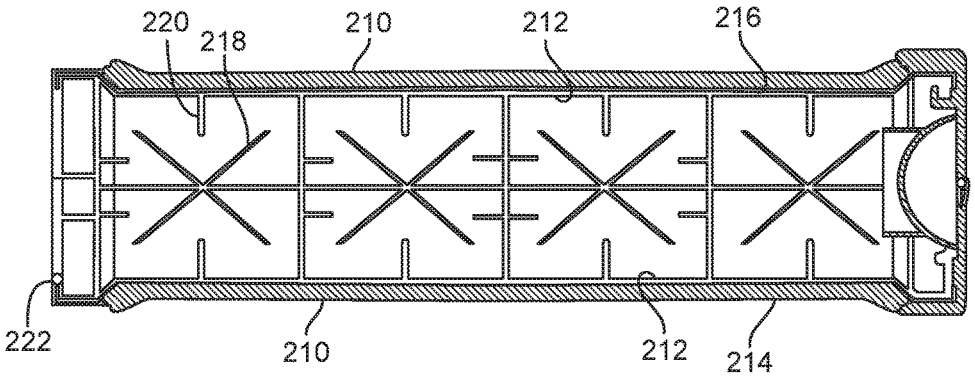
Figure 32:
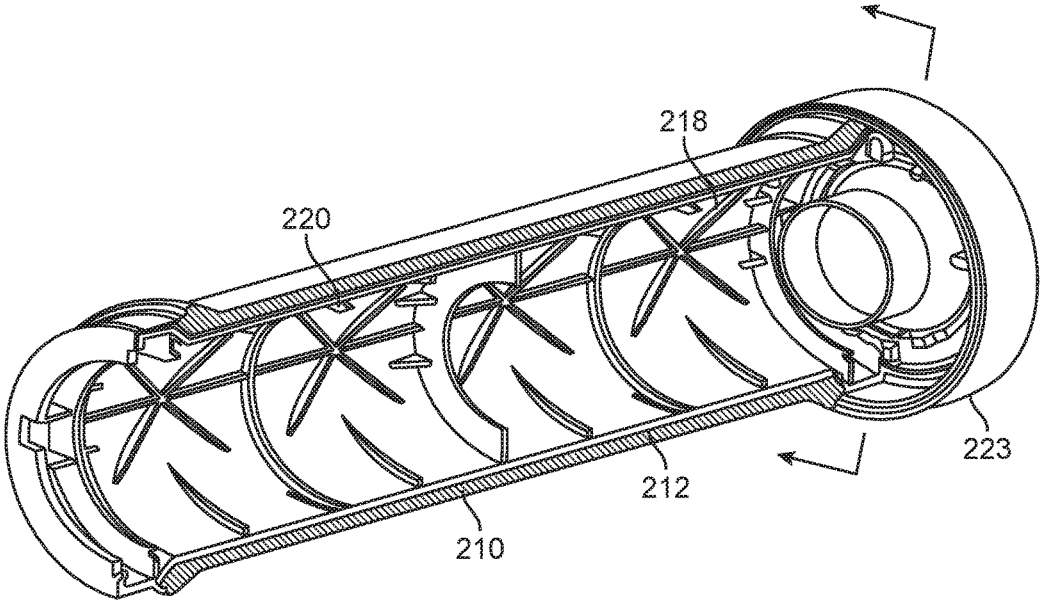
Figure 33:
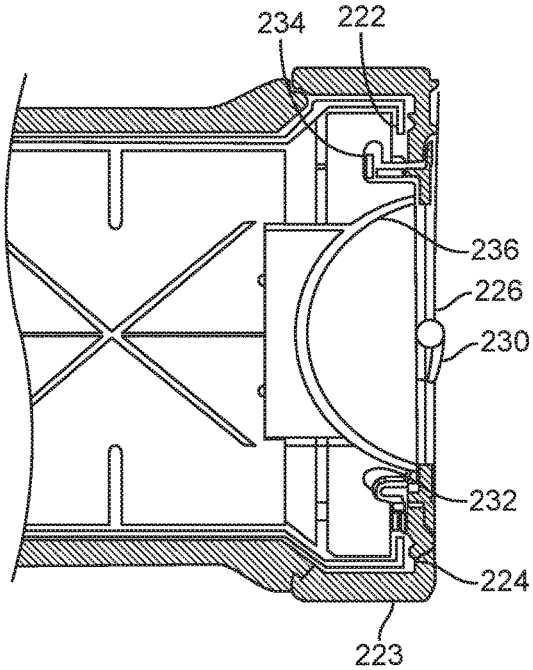
Figure 34:
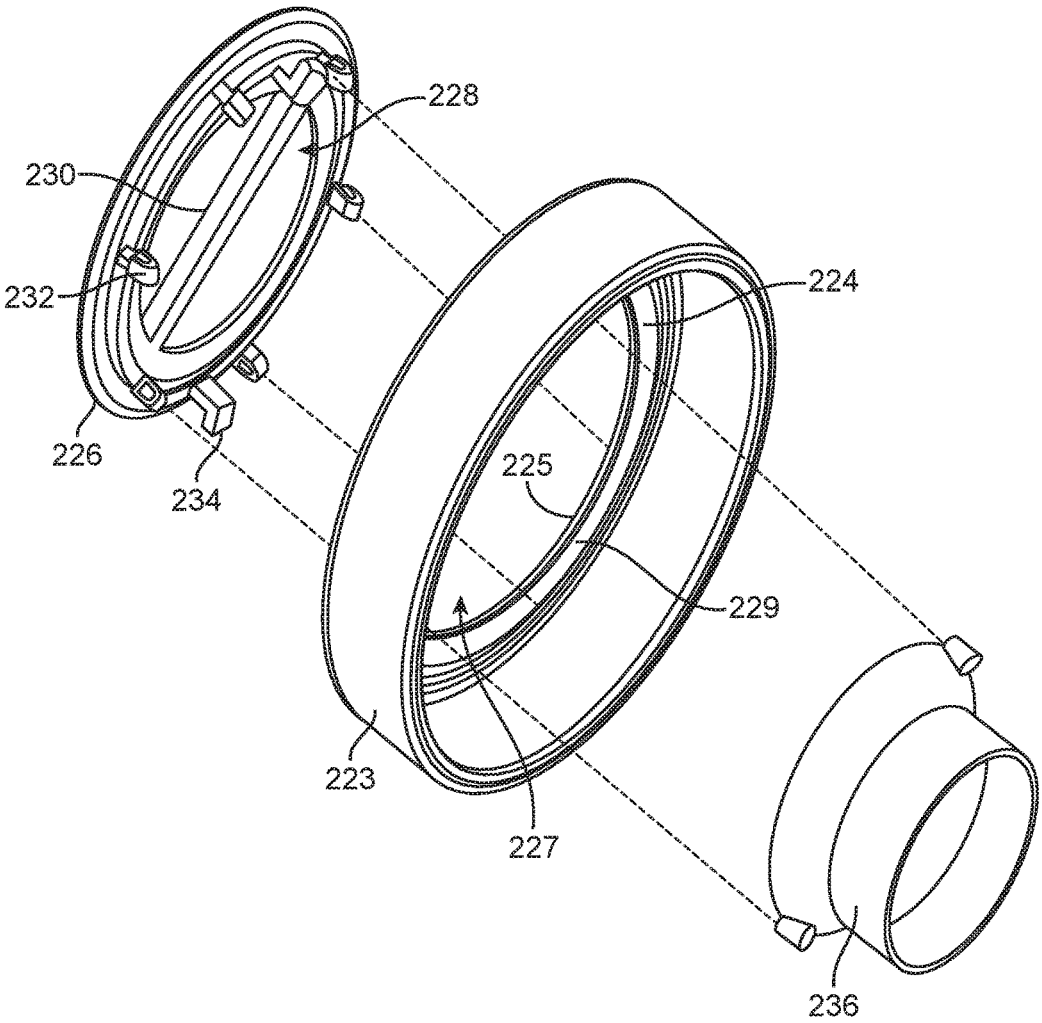
Figure 35:
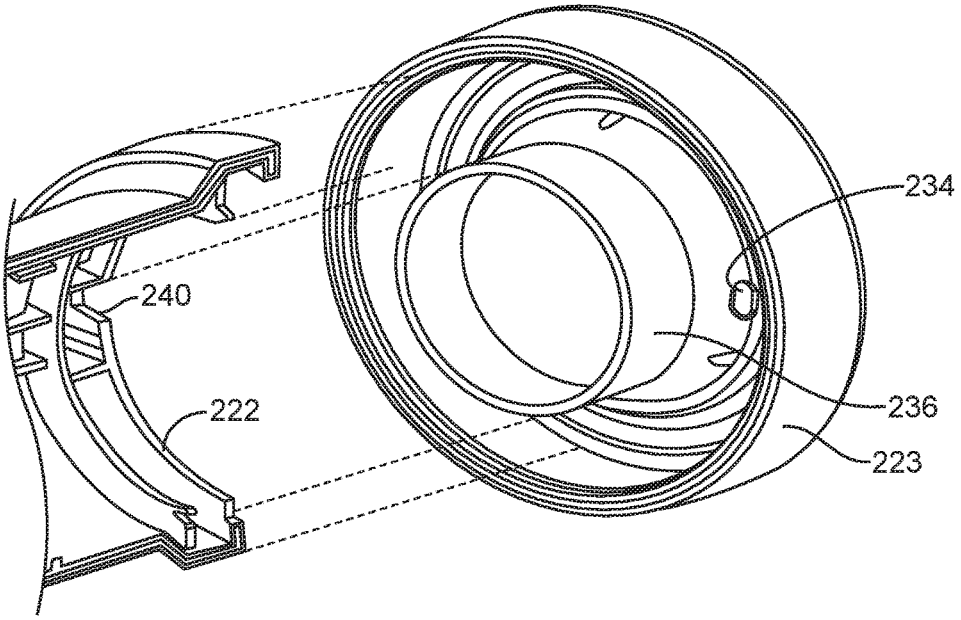

FIG. 20 is a perspective view generally illustrating an alternative embodiment of an improved massage roller and depicting at opposite ends thereof alternative end cap configurations in accordance with the present invention;

FIG. 21 is an exploded perspective view illustrating several component parts of the embodiment shown in FIG. 20;

FIG. 22 is a broken longitudinal cross-sectional view taken along the plane of the arrows 22-22 of FIG. 20 and illustrating internal details of the embodiment;

FIG. 22A is a transverse cross section of FIG. 22 taken along the line 22A-22A;

FIG. 23 is an exploded perspective view showing mating details of the cover pad/substrate subassemblies of the embodiment of FIG. 20;

FIG. 24 is an exploded perspective view showing details of the mating substrate parts of the embodiment of FIG. 20;

FIG. 25 is an exploded perspective view showing details of the threaded end of the substrate parts illustrated in FIG. 24;

FIG. 26 is an exploded perspective view showing details of the unthreaded end of the substrate parts illustrated in FIG. 24;

FIG. 27A is an exploded perspective view showing details from one side of the unthreaded end cap of the embodiment illustrated in FIG. 20;

FIG. 27B is an exploded perspective view showing details from the opposite side of the unthreaded end cap of the embodiment illustrated in FIG. 20;

FIG. 27C is an exploded perspective view showing details from the opposite side of the unthreaded end cap of the embodiment illustrated in FIG. 20;

FIG. 27*d* is a partial cross section view showing details relating to the end cap latching function of the embodiment illustrated in FIG. 20;

FIG. 28A is a perspective view showing the locking mechanism of the assembled unthreaded end cap of the embodiment illustrated in FIG. 20 in an unlocked configuration;

FIG. 28B is a perspective view showing the locking mechanism of the assembled unthreaded end cap of the embodiment illustrated in FIG. 20 rotated into a locked configuration;

FIGS. 29A and 29B respectively show opposite sides of a threaded end cap of the embodiment illustrated in FIG. 20;

FIG. 30 is a perspective view generally illustrating another alternative embodiment of an improved massage roller in accordance with the present invention;

FIG. 31 is a longitudinal cross-sectional view taken along the plane of the arrows 31-31 of the embodiment of FIG. 30 and illustrating internal details thereof;

FIG. 32 is a partial perspective view showing various internal details of the embodiment of FIG. 30;

FIG. 33 is a partial transverse cross-sectional view taken along the arrows 33-33 of FIG. 32 and illustrating internal details thereof;

FIG. 34 is an exploded perspective view showing the several component parts of an end cap of the type illustrated in FIG. 32; and FIG. 35 is an exploded perspective view showing the method of attachment of an end cap of the type illustrated in FIG. 32.

Figure 36:
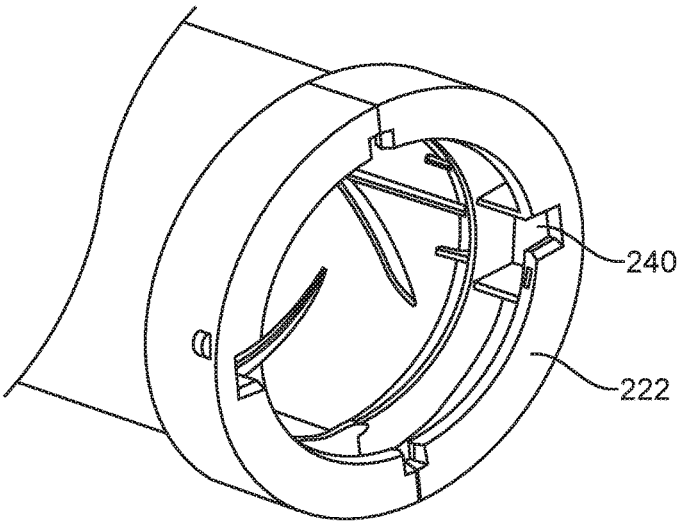

FIG. 36 is partial perspective view showing an end of the roller body of FIG. 30 before attachment of an end cap of the type illustrated in FIG. 35.

DETAILED DESCRIPTION OF EMBODIMENTS

Figure 1:
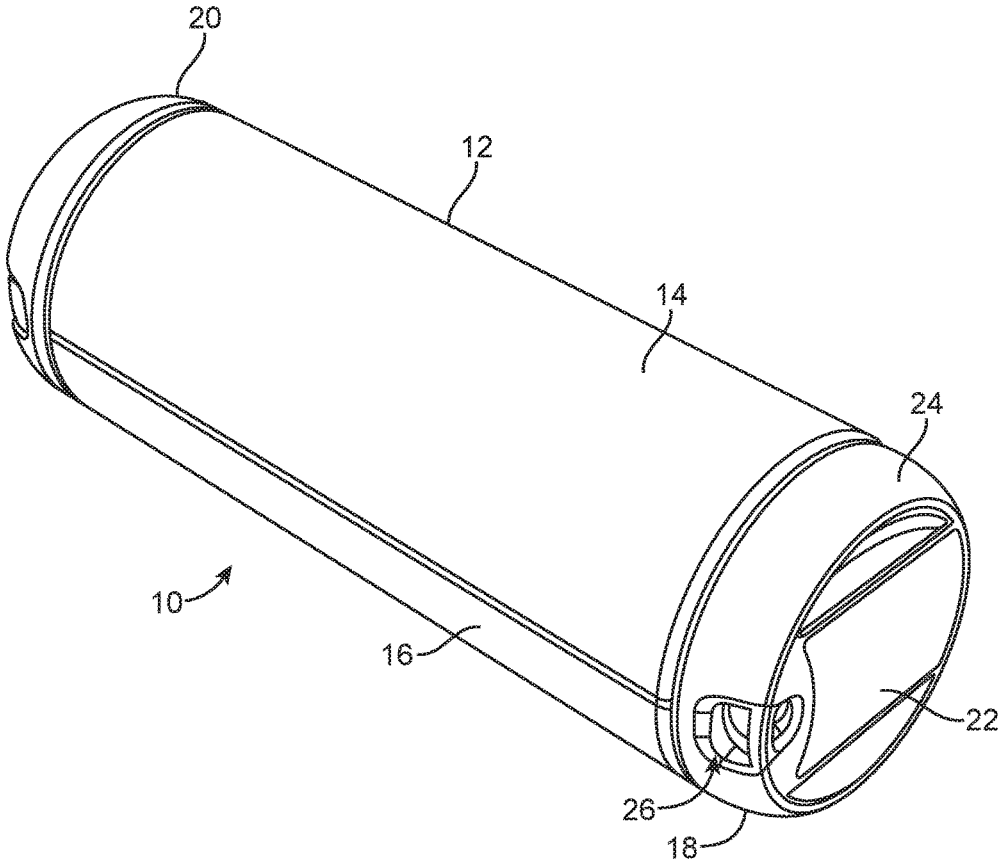
FIG. 1 is a perspective view generally illustrating an embodiment of an improved massage roller in accordance with the present invention.

Referring to FIG. 1 of the drawing, an embodiment of an improved massage roller in accordance with the present invention is illustrated at 10 and includes a roller body 12 comprised of, inter alia, a pair of replaceable resilient therapeutic massage pads 14 and 16 made of EVA or polyurethane or the like, and a pair of substantially rigid, injected molded PVC or nylon end caps 18 and 20. Note that as will be further disclosed below, the end caps 18 and 20 include a substantially rigid cap part 22 adapted to mate with the body 12, and a resilient collar 24 also made of EVA or polyurethane or the like. In addition, the end caps may include a recessed opening, passageway and keeper 26 to which an accessory carry strap (not shown) may be attached for accommodating transport of the roller device.

Figure 2:
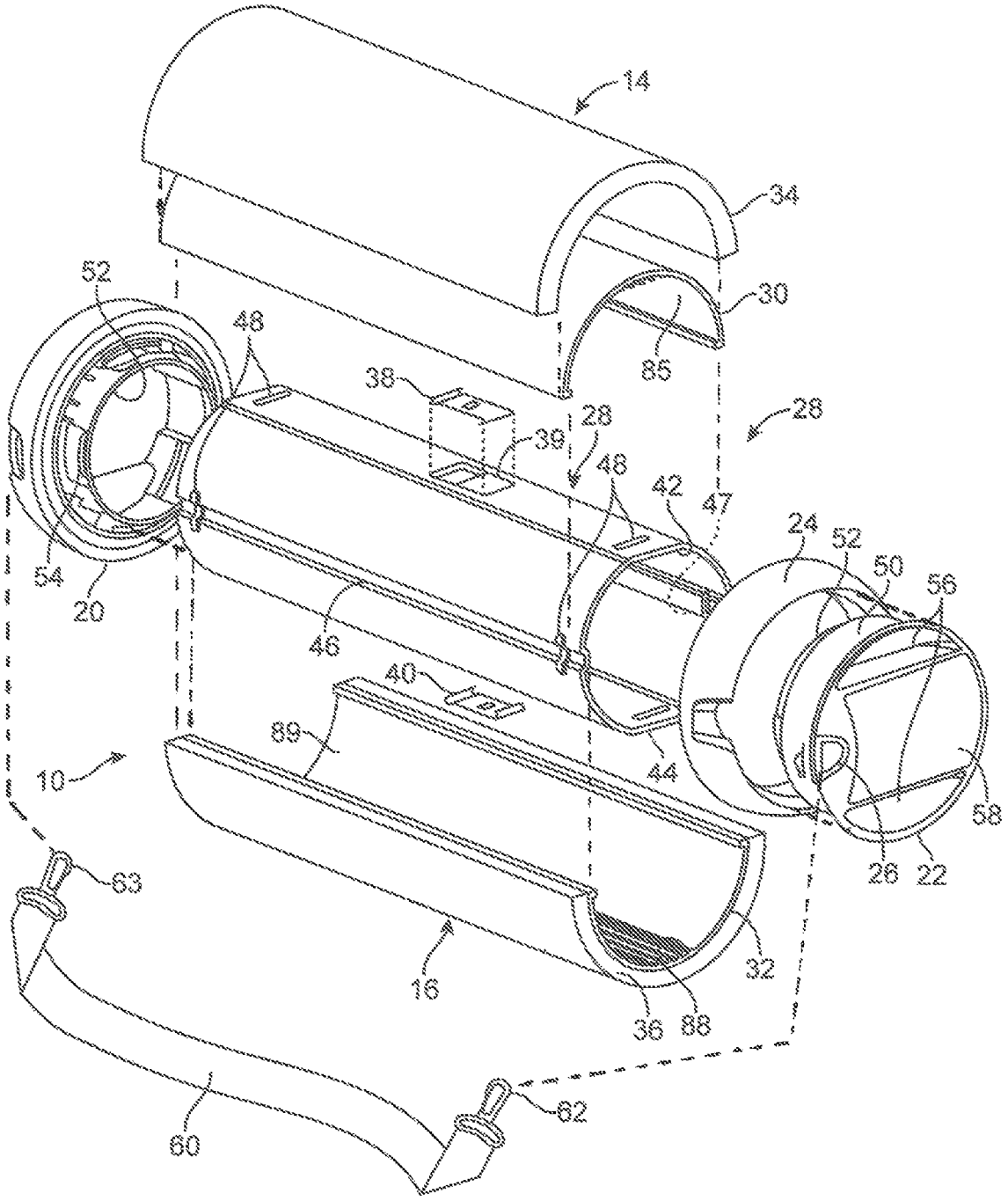
FIG. 2 is an exploded view illustrating the several components of the embodiment shown in FIG. 1.

Turning now to FIG. 2, which is an exploded perspective view of the subject massage roller 10, the body 12 includes a rigid core 28, a pair of substrates 30 and 32, and a pair of resilient cover pads 34 and 36. In addition, the core 28 has attached thereto a pair of spring clips 38 and 40 to be described below. As will also be further explained below, the cover pads 34 and 36 are respectively fastened to the substrates 30 and 32 by a suitable fastening means such as glue, mastic or even a mechanical fastener such as Velcro or the like.

As depicted, the core 28 is preferably generally cylindrical and tubular in configuration, but has two diametrically opposed, longitudinally extending flats 42 and 44 respectively formed in its top and bottom surfaces. Each flat is advantageously provided with a recessed opening and slot 39 for receiving and mating with a spring clip 38/40. Core 28 also has two diametrically opposed slots or channels 46 and 47 respectively extending longitudinally along its sides, and four orthogonally positioned and transversely extending slots 48 formed therein proximate each extremity. Core 28 is preferably an extruded part made of PVC (polyvinylchloride), or similar material, with the transverse slots 48 made by sawing, punching or stamping. The thickness of the extrusion is chosen to be suitable for the application.

As will be further described below in more detail, end caps 20 and 22 include an annular perimeter 50 for receiving and supporting the annularly configured resilient collar 24 which is adhered thereto by a suitable glue or mastic, and a cylindrical, rearwardly extending neck portion 52 for mating with the openings at the ends of core 28. In addition, the necks 52 are provided with four radially extending tabs 54 for lockingly engaging the slots 48 from inside core 28. The outwardly facing surfaces of caps 20 and 22 have recessed finger openings 56 provided therein for receiving a user's fingers and defining a "handle" 58 and enabling the user to conveniently insert the neck 52 into an end of core 28 and rotate the cap to lockingly engage the tabs 54 with the slots 48.

Shown below the exploded assembly is a an optional strap 60 having suitable snap fasteners 62 and 63 affixed to each end to permit attachment of the strap to the keepers crossing the openings 26 in the end caps 20/22 installed at each end of the assembled roller to provide ease of transport thereof. Alternatively, a carabiner or other suitable strap fastener may be used.

Figure 3:
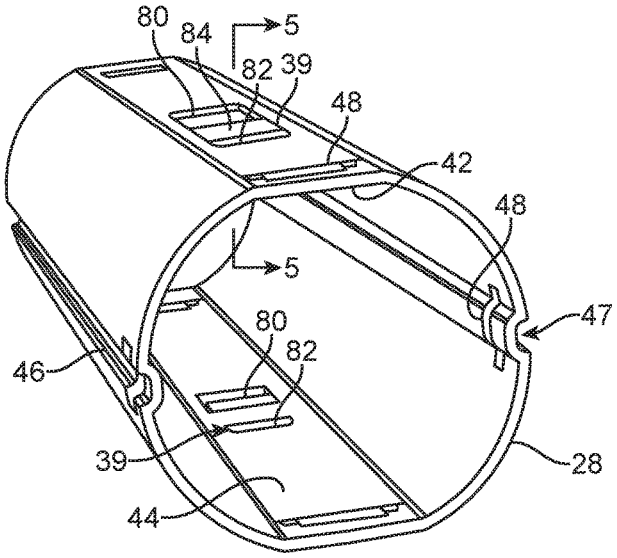
FIG. 3 is a perspective view showing functional details of the core component illustrated in FIG. 2.
Figure 4:
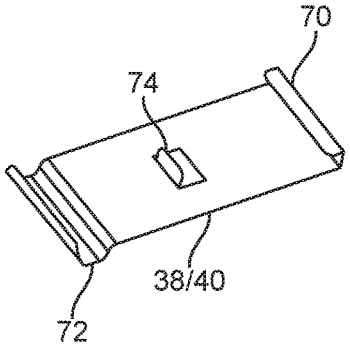
FIG. 4 is a perspective view showing the spring clip component illustrated in FIG. 2.
Figure 5:
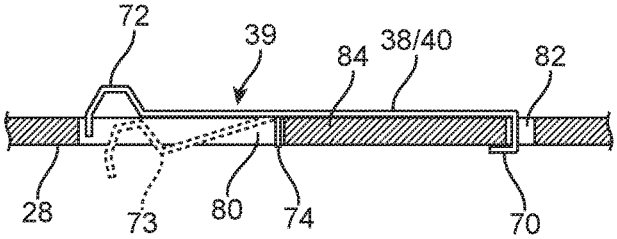
FIG. 5 is a cross-sectional view taken along the plane of the arrows 5-5 of FIG. 3 and illustrating the installation and operation of the spring clip shown in FIG. 4 as it is installed on the core depicted in FIGS. 2 and 3.

Referring to FIGS. 3-5, and as depicted in FIG. 3, and shown in greater detail in the cross-section taken according to the arrows 5-5 and depicted in FIG. 5, core 28 includes a pair of receptacles 39 for receiving, mating with and accommodating the spring clips 38/40. In FIG. 4, additional details regarding the spring clips 38 and 40 and their relationship to core 28 are discussed, as well as their specific relationships to core 28. As depicted in inverted form in this figure, it will be understood that the clips 38/40 are preformed elements made from elongated strips of 28-gauge spring steel, and include at one end thereof, a transversely extending hook-like structure 70 formed upwardly to one side of the strip, and a detent-forming hook-like structure 72 formed to extend downwardly at the other end. Intermediate the ends, an upwardly extending tab 74 is formed. In the illustrated embodiment, the receptacles 39 include a rectangular spring relief opening 80 and a transversely oriented slot 82, the two being separated by a recessed surface area 84.

As is apparent from the showing in FIG. 5, which is a cross-section taken along the line 5-5 in FIG. 3, the spring clips can be mounted to the core 28 by inserting the hook 70 into the slot 82 and then rotating and pulling the clip leftwardly into the recessed surface area 84 until the tab 74 enters the opening 80 and serves as a retainer for the clip. With the clip so installed, the portion thereof extending over the recessed surface area 84 is normally flush with the core surface, and the portion 73 thereof extending over the opening 80 and terminating in the hook 72 provides a resilient, upwardly (outwardly relative to the outer surface of the core) extending detent 72 which can be biased downwardly in cantilever fashion into the opening 80 as indicated by the dashed lines 73.

Figure 6:
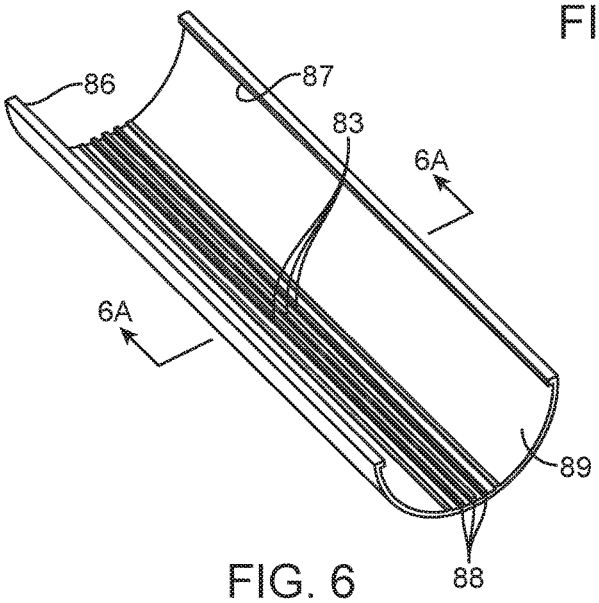
FIG. 6 is a perspective view showing functional features of the underside of the cover pad substrate component illustrated in FIG. 2.

In FIG. 6, the reverse, or internal, sides 85 of the cover substrates 30 and 32 depicted in FIG. 2 is shown to include inwardly turned lateral edges 86 and 87 which, as further discussed below, will respectively engage the channels 46/47 (FIG. 3) and secure the substrates to core 28. This figure additionally reveals several elongated ridges or ribs 88 formed on the inner substrate surface 89 and running the length thereof. Also shown are notches 83 formed mid-length along ribs 88 which, as will be disclosed below, will be engaged by the detents 72 (FIG. 5) to longitudinally lock the substrates 30/32 in position on core 28.

Figure 6A:
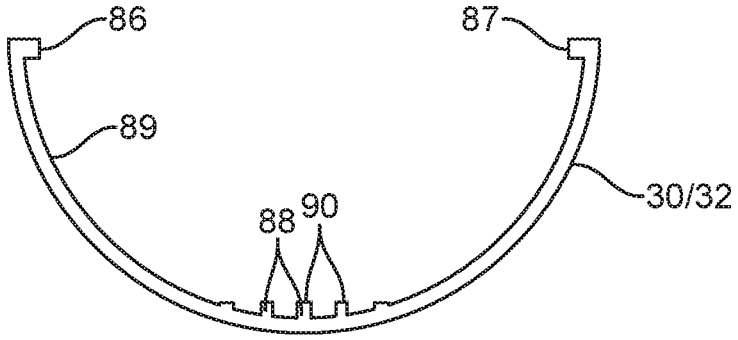
FIG. 6A is a transverse cross-sectional view of the cover pad substrate component taken along the plane of the arrows 6A in FIG. 6.
Figure 6B:
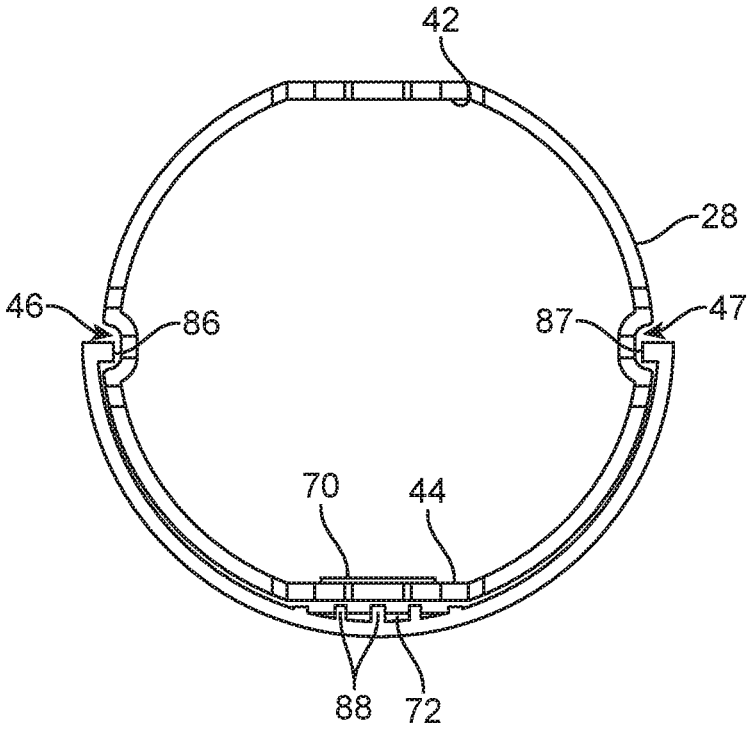
FIG. 6B is a cross-sectional view as in FIG. 6A showing the cover pad substrate component and its relationship to the core shown in FIGS. 2 and 3.

As is perhaps be better shown in the transverse cross-section 6A-6A taken along the plane evidenced by the arrows 6A shown in FIG. 6, the rib-tops 90 are disposed co-planar with and adapted to ride on the external surfaces of the core flats 42/44, as further illustrated in the lower part of the cross-section of FIG. 6B, when the substrate is installed on the core 28. Note in this figure the inwardly positioned extremity of the hook 70, previously described and shown in FIG. 5. In this figure the extension of the detent 72 into the rib notches 83 is shown.

Figure 7:
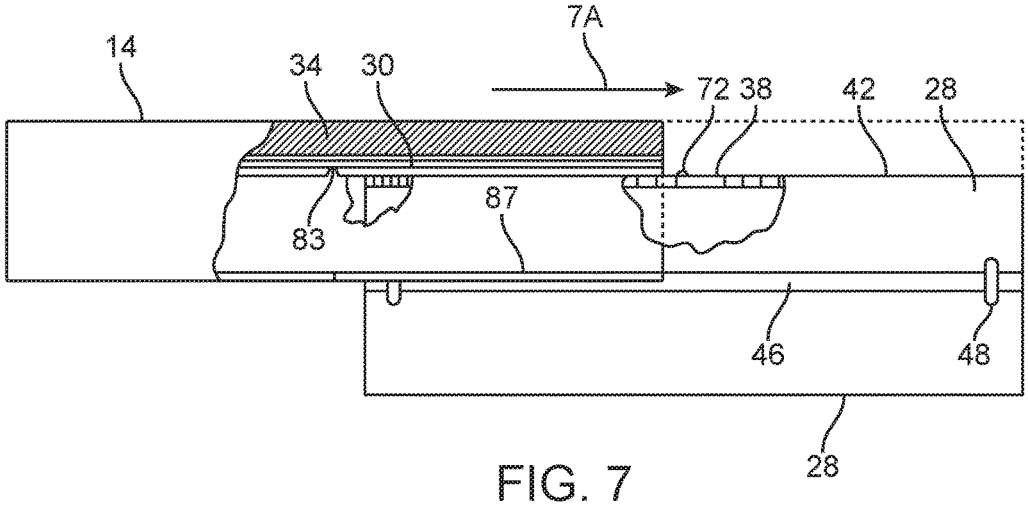
FIG. 7 is a partially broken side view illustrating installation of the assembled cover pad/substrate onto the core shown in FIGS. 2 and 3.
Figure 8:
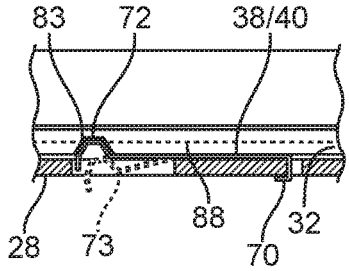
FIG. 8 is a broken partial cross-sectional view illustrating operation of the spring clip of FIG. 4 in centering the assembled cover pad/substrate onto the core depicted in FIG. 7.
Figure 9:
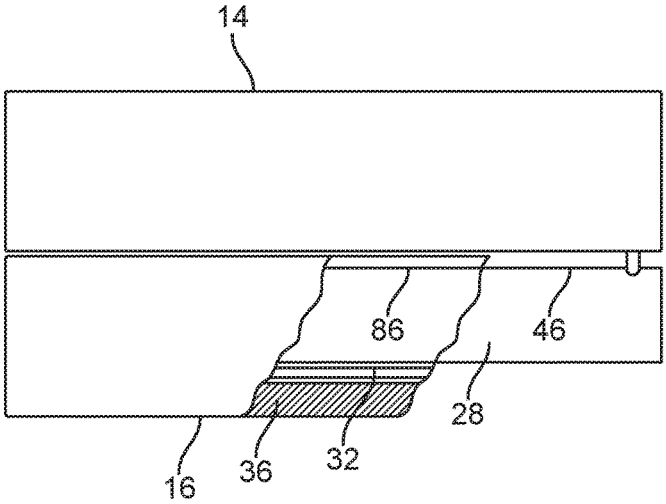
FIG. 9 is a partially broken side view illustrating an assembled massage roller in accordance with the present invention before the end caps shown in FIGS. 1 and 2 are attached.

Turning now to FIGS. 7-9, installation of the cover pad/substrate subassemblies or modules 14/16 to the core 28 is illustrated. As shown in the partially broken side view of FIG. 7, after the cover pad 34 is attached to the substrate 30, and one end of the subassembly is positioned at an end of the core 28 with its internally extending side edges 86/87 aligned with the side grooves 46/47, the top surfaces 90 (FIG. 6A) will be aligned with the outer surface of the flat 42, and the unit 14 can be slid along the length of core 28 as suggested by the arrow 7A. As the leading edge of the subassembly reaches the detent 72 at the middle of core 28, the intersection of the ribs 88 with the detent 72 will cause the detent and cantilevered portion of the spring clip 38 to be resiliently depressed into the opening 80, as illustrated by the dashed lines 73 in the cross-section of FIG. 8. The rightward movement of the subassembly can thus continue until it is stopped at the end of the core by the detent 72 engaging the notches 83 in the ribs 88. The lower pad subassembly 16 is then similarly installed on core 28.

In FIG. 9, the completed assembly of the replaceable massage pad units 14 and 16 to the core 28 is illustrated in a side view with the subassembly 16 broken to show the respective relationships of pad 36 to substrate 32 to core 28. With the pads thus assembled to core 28, the subject roller assembly is not yet complete but could be used without the end caps. However, to complete the preferred embodiment of the present invention all that is needed is to install the two end caps.

Figure 10:
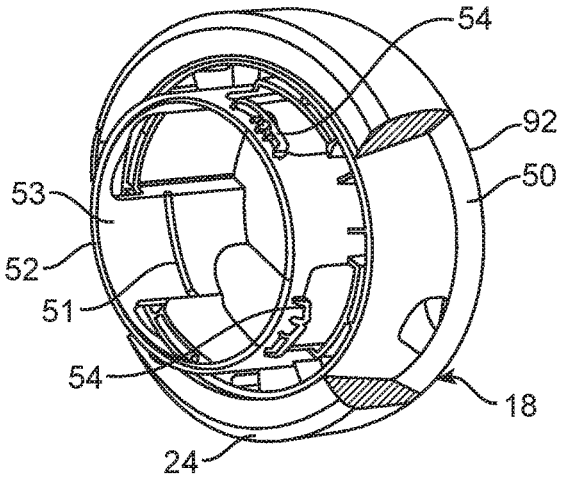
FIG. 10 is a perspective view showing structural and functional details of the end caps and associated collars depicted in FIGS. 1 and 2.

FIG. 10 is a partially broken perspective view illustrating the inside features of an injection molded end version of the end cap 18 previously shown in FIG. 2. As depicted, the cap includes a tapered outer perimeter portion 92 and an annular portion 50 configured to receive the resilient collar 24. In addition, the cap includes an inwardly extending neck portion 52 adapted for insertion into the inner bore of the core 28 described above. In one embodiment the collar 24 is suitably affixed with glue, or the like, to the surfaces 50 and 92. The neck portion 52 is configured to have four outwardly extending retainer tabs 54 orthogonally positioned about the neck portion for lockingly engaging the core slots 48. As will be further described below, the tabs are made somewhat flexible in the axial direction of the cap. On the inner surfaces 53 of the neck portion, inwardly extending partial annular ribs 55 are formed to serve as retainers for a container device, or the like, nested within the cap as will be described below.

Figure 11:
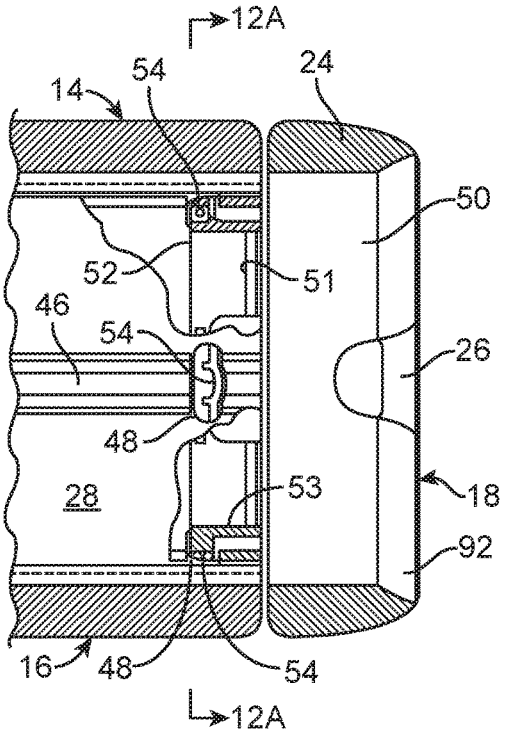
FIG. 11 is partially broken cross-sectional view showing a cap assembly mounted to one end of an assembled roller in accordance with the present invention.

FIG. 11 is a partially broken cross-sectional view further clarifying certain end cap details and cap-to-roller body relationships. In this figure, a generalized cross-sectional view of end cap 18 is shown with the cap mated to an end of the core 28 after the pad modules 14 and 16 have been installed on the core. As depicted, the neck 52 has been inserted into the end of core 28, and has been rotated into its locked position relative to the core, and with its locking tabs 54 in engagement with the core slots 48. Note that, in the middle of the figure. a portion of a locking tab 54 is visible through the slot 48. At the top and bottom of the figure, two of the other three tabs 54 are shown in cross-section extending into the top and bottom slots 48. In this figure, the interior surface 53 of neck 52 and portions of the article container retainer rib 55 are also shown.

Figure 11A:
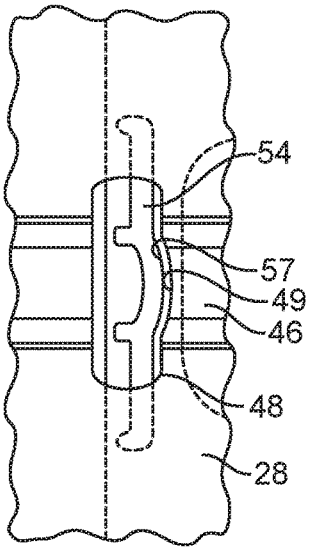
FIG. 11A is a broken plan view showing details of the end cap locking tab, detent and core slot generally illustrated in FIG. 11.

FIG. 11A is a broken plan view showing further details of the end cap locking tab 54 and core slot 48 generally illustrated in FIG. 11. As is more clearly illustrated in this figure, the right side of the slots 48 are bowed out to provide shallow locking recesses 49 for receiving locking detents 57 formed in the mid-portions of the retainer tabs 54. Note that the cap retaining and locking tabs 54 are designed to be somewhat flexible so that upon engagement with the slots 48 they resiliently cam in the axial direction of the cap and then snap into a locking configuration as the detents 57 reach and mate with the recesses 49.

Figure 12A:
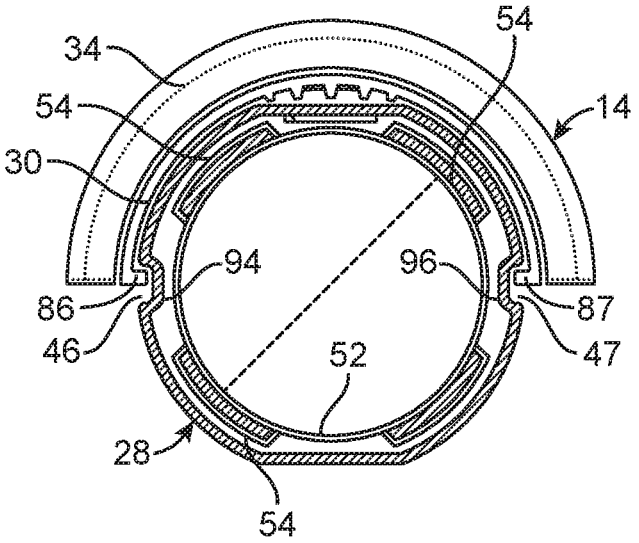
FIGS. 12A and 12B are simplified partially broken cross-sectional views looking in the direction of arrows 12A-12A in FIG. 11 and illustrating the locking engagement of an end cap to the roller core.
Figure 12B:
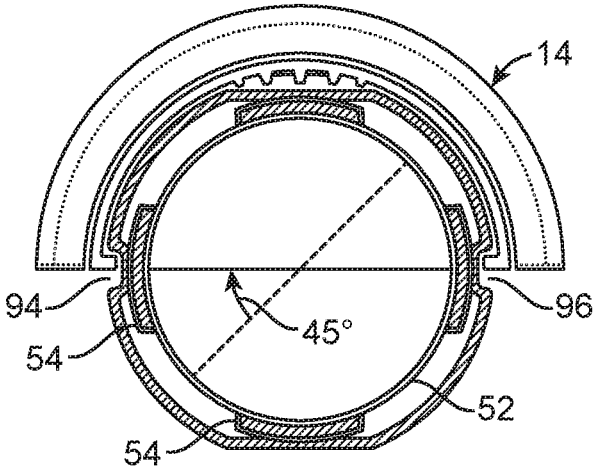

FIGS. 12A and 12B are simplified pseudo cross-sectional views further illustrating the end cap locking operation and relationships between the cap neck 52, core 28, substrate 30 and pad 34 components previously described. For simplicity, only the upper pad-substrate module 14 is shown mounted to the core 28. Specifically, in FIG. 12A, the cap mating and rotational disposition of the cap neck 52 is shown with its locking tabs rotated 45 degrees from a vertical/horizontal disposition in order to clear the side groove forming core deformations 94 and 96 upon insertion of the cap neck into the end of core 28.

In FIG. 12B, the angular rotation of the cap neck 52 and its retainer tabs 54 with respect to the groove forming portions 94 and 96 of the core 28 in order to lock the cap in place is shown, i.e., by rotating the cap 45 degrees in either direction, the distal ends/edges of the tabs 54 will be caused to pass into the slots 48 formed in core 28. As mentioned above, the retaining function of the engagement of substrate edges 86 and 87 within the core side grooves 46 and 47 is depicted in FIG. 11A.

As will be understood by those skilled in the art, the radial dimension of the end cap tabs 54 must be less than the primary inside diameter of the core 28 in order to allow the neck 52 to enter the ends of the core (with the cap rotationally positioned as depicted in FIG. 12A), but must be large enough to extend into the slots 48 in the core flats 42 and 44, and the groove forming deformations 46 and 47 when the cap is rotated 45 degrees (as suggested by FIG. 12B), in order to lock the cap in position at the end of the core.

Figure 13:
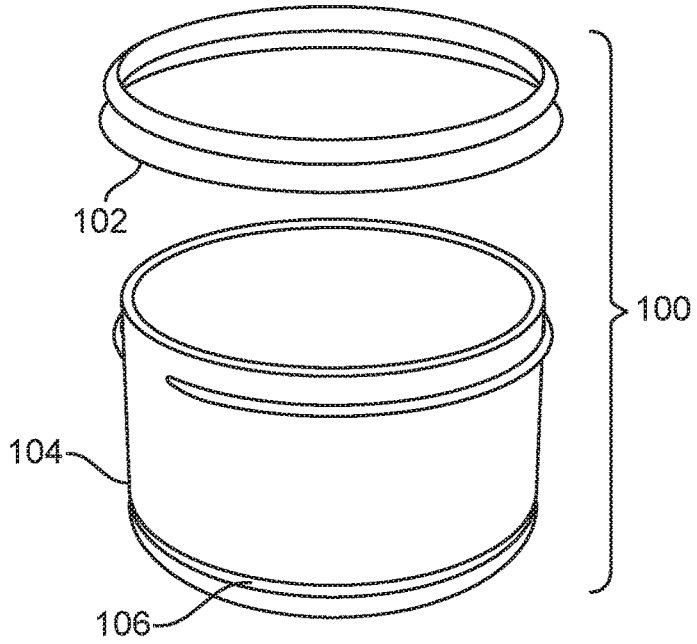
FIG. 13 is an exploded perspective view showing an embodiment of a container adapted to be attached to an end cap and inserted into the roller upon attachment of the end cap to the roller.
Figure 14:
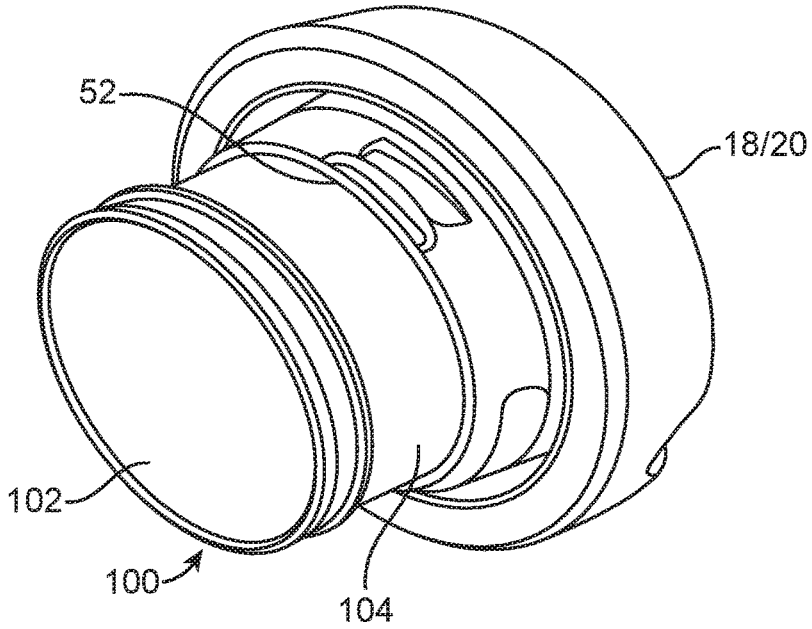
FIG. 14 is a perspective view illustrating attachment of the container of FIG. 13 to the inside of an end cap.
Figure 15:
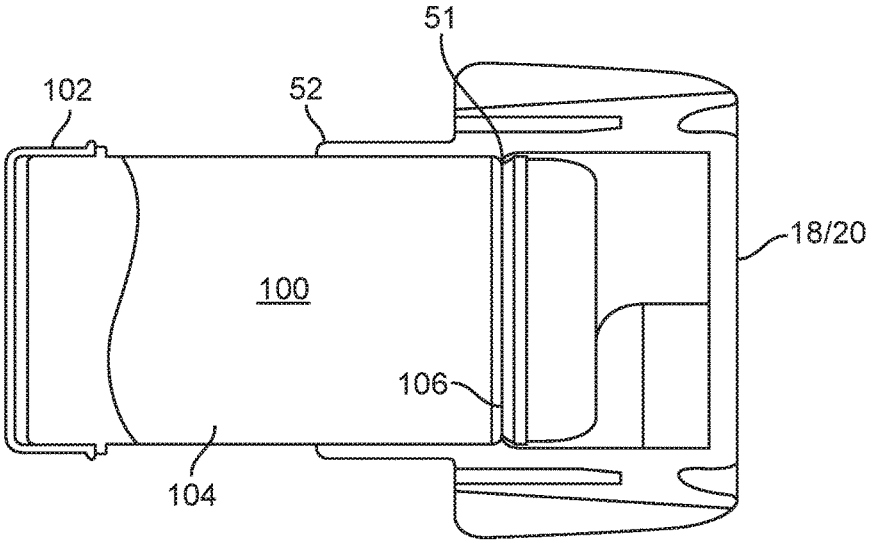
FIG. 15 is a partially broken cross-sectional view further illustrating attachment of the container of FIGS. 13 and 14 to the inside of an end cap.

As alluded to above, the hollow inside of the core 28 may be used to store sundry items such as exercise clothing, car keys, locker keys, etc. In one embodiment, a cup shaped container 104 and cap 102, such as that illustrated at 100 in FIG. 13, might be provided and attached to, or be carried by, one of the end caps 18/20, as depicted in FIG. 14 and the partially broken sectional view of FIG. 15. In this embodiment, the container 104 may have an outside diameter slightly smaller than the inside diameter of the cap neck 52 and be provided with an annular groove 106 near its base to effect a retaining engagement with an annular rib or set of partial annular ribs 51 molded inside the cap neck (see also the showing of such a rib-like retainer 51 in the cap 18 shown in FIG. 10). In this embodiment the container would be press-fit into the cap and be removeably retained therein by the engagement of groove 106 with rib 51. Alternatively, the container might be made more easily removable by the use of a suitable screw and thread arrangement.

Figure 16:
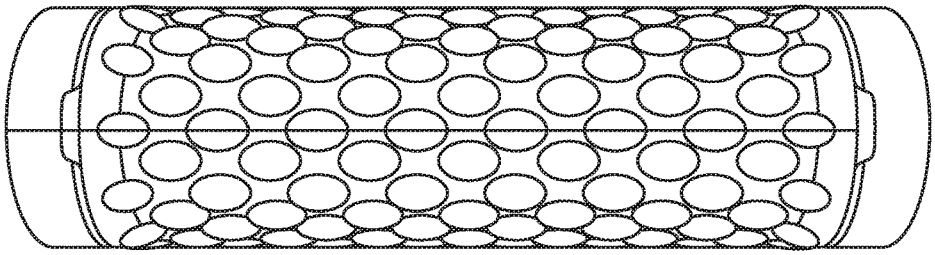
FIGS. 16 and 17 are side views illustrating rollers having alternative pad surfaces in accordance with other embodiments of the present invention.
Figure 17:
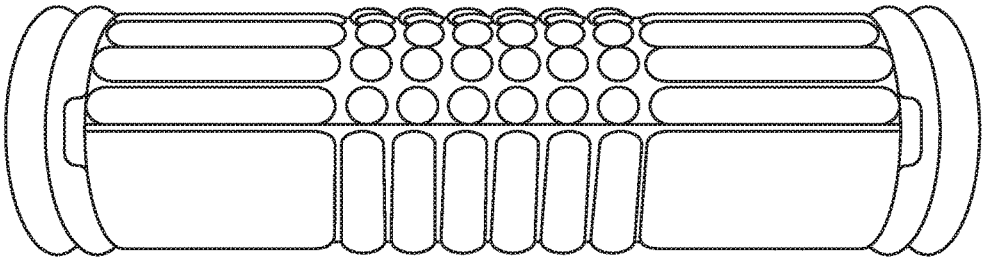

Referring now to FIGS. 16 and 17, although the surfaces of the roller pad modules described above are shown as being smooth, alternative, less smooth, dimpled or ribbed pad surface configurations or the like adapted to achieve particular therapeutic results may also be used. For example, the surface may include molded spheres or hemispheres such as is illustrated in FIG. 16, or peaks, or annular or elongated ridges, or other suitable configurations. In addition, pads with different or unmatched surface configurations such as are illustrated in FIG. 17 can be used.

As described above with respect to the preferred embodiment, in order to install the roller pads on a core, one would simply position one end of each pad-substrate module at an end of the core, align the inwardly turned side edges of the pad carrying substrate with the elongated core side grooves, and slide the subassemblies longitudinally along the core, passed the centrally disposed detent until the detent engages the notches formed in the ridges on the bottom surfaces of the substrates, at which time the subassemblies will be properly placed and retained in position by the detents until the end caps are installed. To remove the subassemblies from the core, the operation would simply be reversed allowing a new or different pad or pad set to be installed on the core.

An alternative embodiment might include the use of a more flexible substrate or substrate material that would allow mounting of the pad modules to the core by simply forcing each pad-module over the core, as suggested by the arrows X and Y in FIG. 18, until the inwardly extending substrate edges flex out and cam over the core surfaces, and snap into place in the core side grooves. In this case, the end caps might be relied on to maintain the pads in their longitudinal positions relative to the core. This is to say, without use of the centering spring clip. Alternatively, one might use one or more small magnets, Velcro strips, or other similar materials or devices to center the pad assemblies on the core. In this embodiment, in order to remove the pad modules from the core, one would remove one of the end caps and spread the substrate to disengage the side edges from the core grooves, and then lift the subassembly from the core, or if no centering device was used, simply slide the module off of the core.

In still another embodiment, and as illustrated in FIG. 19, a core 130 with three or more elongated side grooves 132 might be used to accommodate a corresponding plurality of pad-substrate modules 134 that could be mounted on and secured to the core 130 in a manner similar to the above described methods. In using this embodiment one could use a desired plurality of pad surface textures or degrees of softness (or hardness) to achieve a desired therapeutic result In yet another embodiment other forms of detents (not shown), or slot configurations, might be used. Similarly, other substrate edge configurations might be provided for engaging the slots 48 or other slots provided in the core to laterally secure the cover pad modules in place on the core.

In FIG. 20, a further embodiment of the present invention is illustrated at 140 and includes a therapeutic roller device comprised of, inter alia, a pair of replaceable resilient therapeutic massage pad assemblies 141 and 142 mated together at a split line 143 similar to that described above, and a pair of end caps 144 and 146 that secure the assemblies together. Unlike the previously described embodiments, this embodiment includes no rigid core 28 as described above, includes parts that snap together, and a new type of end caps that are preferably slightly larger in outer diameter than the massage pad assemblies so that the user's body weight applied to the massage pads is transferred, or distributed, to the end caps. As a result of the new end cap designs, the pad assemblies are effectively separated from the floor, or other supporting platform, such that the surface characteristics of the pads do not adversely affect the smoothness of the roll as the user moves the device across the floor.

As will be further disclosed below, the end caps 144 and 146 are advantageously rigid in construction. In one embodiment, the rolling surface thereof is preferably over-molded or otherwise fitted with a relatively thin resilient coating of rubber or plastic. In another embodiment, the over-mold is of a less resilient material and is thicker in the radial dimension of the cap.

Although the end caps of this embodiment are usually of at least substantially the same configuration, in order to simplify this disclosure, and as illustrated in the exploded perspective view of FIG. 21, one end of the roller body is shown as having a threaded end 148 for receiving an internally threaded cap unit 144, and the other end is shown in an unthreaded configuration 150 including a raised shoulder forming portion of substantially larger diameter than that of the substrate parts 152 and 156 (FIG. 22). This channel shaped (FIG. 21) part of the substrate assembly forms a structurally stout annulus for engagement with the thin walled cap 146, and in combination therewith allows the cap to support user loads transferred thereto. As depicted in the cross section of FIG. 22, it will be noted that when engaged with the relatively thin walled cap 146, the annulus 150 is received within and enveloped by the outer said band of the cap FIG. 22, which is a broken, longitudinal cross-section taken along the plane defined by the arrows 22-22 in FIG. 20, the roller body formed by the mated massage pad assemblies 141 and 142, which are aligned and joined together at the split line 143, is held together by the locking engagement of caps 144 and 146 to the respective ends of the body.

Assembly 141 is comprised of an elongated half-round substrate 152 having a preformed dimpled layer or shell of foam pad material 154 affixed thereto using well-known bonding techniques of the type described above. The substrate 152 is preferably a molded plastic part having connection facilitating features formed on each end as illustrated.

Assembly 142 is similarly comprised of an elongated half-round substrate 156 having a preformed layer or shell of foam pad material 158 affixed thereto. Either or both of the shells may be made of a material having a plain or specifically textured outer surface. The substrate 156 is, like substrate 152, preferably a molded plastic part having the same connection facilitating features formed on each end as does substrate 152.

As depicted in FIGS. 23 and 24, one side edge of each substrate includes a channel or groove 166 (or series of channel or groove segments) running from substantially one end of the edge to the other, and the other side edge of each substrate includes an upstanding rib (or series of rib segments) running the length thereof such that when the two substrates are mated together, the ribs enter and mate with the channels.

As also shown in FIGS. 22A, 23 and 25, an alignment pin 170 and socket 172 are respectively formed in the side edges of each end portion of the substrates two achieve and maintain axial alignment of the mated substrates.

As pointed out above, for purposes of illustration, and as also depicted in FIGS. 21-25, one end of each substrate is configured to have external threads 148 formed on an end portion thereof to collectively form, when the substrates are mated together, a threaded cylindrical surface adapted to be engaged by internal threads 160 formed in an end cap 144. The purpose of such engagement is to capture that end of the mated massage pad assemblies 141 and 142 and to hold them together to maintain the integrity of the roller body during use of the device.

As also shown in FIGS. 22-24 and 26, the other ends of the substrates are configured to collectively form, when mated together, a cylindrical surface 150 adapted to be received by an end cap of a different type; namely a cap having a concave cylindrical opening (see FIG. 22) designed to receive and enclose the cylindrical end 150 of the mated substrates, as shown in FIGS. 22 and 27D, and thereby capture that end of the substrates.

Transverse webs 162 (FIGS. 22 and 22A) are advantageously formed at the midpoints (and perhaps other locations as well) of the substrates 152 and 156 to laterally strengthen the tubular structure. Wall strengthening ribs 164 may also be formed in the interior surfaces of the substrates.

Referring to FIGS. 27A and 27B which are opposing exploded perspective views of the locking mechanism included in the non-threaded latch engaging end cap 146, it will be apparent that this cap embodiment includes a cylindrical outer side wall forming band 180 and an cylindrical inner band 182 joined on the front side (FIG. 27A) by a bezel-like face plate 186 to form a first cap component part 178. The open space 187 formed on the back side (FIG. 27B) by the two wall forming bands is configured to receive the substrate ends 150 as shown in FIGS. 22 and 27D. Inner band 182 is axially slit at several locations to form latch tabs 190 having upstanding detents at their ends for snap engaging slits 191 formed in a second, "latching component" part 192 of cap 146. Two channels 194 for providing clearance for the locking tabs 196 are also formed in the inner band 182.

The latching or locking component 192 is comprised of a cap shaped inner body 198 for carrying the locking tabs 196, and has formed on the front side thereof an outwardly extending web 200 having a strap receiving opening formed therein and a locking handle 204 formed at its outer extremity. As is suggested by the dashed lines, the part 192 is assembled with part 178 by pressing it into the central opening in part 198 until the latch tabs 190 snap into engagement with the slots 191, at which time the handle 204 is nested in depressions 206 formed in the face plate 186. At this time the locking cap is fully assembled and ready for attachment to the a body. The back side of the assembled cap is shown in FIG. 27C. In this figure the locking tabs 192 are shown rotated into their locking position.

FIG. 27D is a partial cross sectional view showing the locking tab 196 in locking engagement with the back side of the substrate web 149. Note the dark hatched over-molding of the cap perimeter.

Turning now to FIGS. 28A and B, the front side of the locking cap 146 is respectively shown with it handle 204 in its unlocked and locked positions.

FIGS. 29A and 29B show the inside and outside of the screw-on cap 144.

Referring now to FIGS. 30-36, a further alternative embodiment of the present invention will be described. In this embodiment, plane surfaced therapeutic massage pads 210 (for example) are shown attached in the manner described above i.e., by suitable glue, mastic or other suitable means, to the substrates 212. However, it is to be understood that as pointed out above with respect to the similar embodiment illustrated in FIGS. 20-29B, either or both of the massage pads 210 may be made of a material having either plain or specifically textured outer surfaces or parts thereof. In addition, whereas one side edge of each substrate is shown to include an elongated channel or groove 166 running from substantially one end of the edge to the other, and the other side edge of each substrate includes an upstanding rib running the length thereof such that when the two substrates are mated together, the ribs enter and mate with the facing channels to maintain alignment of the mating substrate edges, the edges may include a series of discrete channel or groove segments intended to mate with a corresponding series of individual rib segments or the like on the facing side edges. This embodiment is configured to have non-threaded ends similar to those described in the previous embodiment except that in this embodiment the longitudinally extending alignment ribs 214 and grooves 216 formed in the respective side edges of the substrates extend along the full length of the parts. In addition, a different pattern of strengthening ribs 218 and webs 220 may be used. One significant difference is that an apertured annular web 222 (see FIGS. 31, 33, 35 and 36) to which the cap is latched is formed at each end of the assembled substrates as depicted in FIGS. 35 and 36.

The end caps 223 are also of a different configuration; a three-part snap-together combination of elements (see FIG. 34). Note also that in this embodiment, the user body contacting outer surface of the foam pad 210 is located well below the diameter of the end caps.

The end cap parts in this embodiment are shown in exploded view in FIG. 34 and include a cylindrical outer cap shell 223 having a centrally apertured frontal face plate 224 having an annular recess 225 circumscribing the central aperture 227, a circular and rotatable locking plate 226 having D-shaped apertures 228 formed therein to define a transversely extending handle and strap tie 230, a plurality of snap fasteners protruding in a circular array from the back surface, and a pair of rearwardly extending locking tabs 234. The third element of the combination is a container cap 236.

The end cap is assembled by positioning the plate 226 at the central aperture 227 and pressing it inwardly until the snap hooks 232 snap over the edge of the aperture and engage the back surface 229 locking the plate 226 to the faceplate 225. However the engagement between the snaps and the faceplate is loose enough to allow rotation of the plate 226 relative to the cap shell 223. The container cap 236 can then be attached to the plate 226 by snaps or other fasteners. Alternatively, the container cap 236 can be attached to the plate 226 by snaps or other fasteners before the plate 226 is installed in the cap shell 223.

Once the end caps 222 are assembled, they can be attached to each end of the assembled roller body by placing them over the ends of the roller body, aligning the locking tabs with the notches 240 in the web 222 (FIG. 33), and then turning locking handle 230 (and disk 226) until the tabs 234 engage detents 241 on the back side of web 222.

Although the present invention has been described herein in terms of several alternative embodiments, it is intended that the present disclosure not be considered limiting, and that the following claims be interpreted as covering all embodiments that fall within the true meaning and scope of the invention.

The invention claimed is:

1. A hollow, therapeutic massage roller apparatus comprising:

first and second elongated, partially cylindrical, roller pad sub-assemblies, each including a length of rigid substrate material having a layer of resilient foam material affixed to a convex outer surface thereof, said first and second elongated, partially cylindrical, roller pad sub-assemblies having side edges adapted to mate together to form an elongated, hollow cylindrical roller body with said layers of resilient foam material forming a therapeutic roller surface having a transverse first outer diameter, said hollow cylindrical roller body including a first end and a second end opposite to the first end, and wherein each of the first and second ends includes a plurality of notches; and a pair of cylindrical end caps closed on a first axial end thereof and open on a second axial end thereof, the second axial end of each of the pair of cylindrical end caps being adapted to mate with one of said first and second ends of the elongated hollow cylindrical roller body to form a closed container, said pair of cylindrical end caps each having a cylindrical outer surface of a second transverse diameter greater than the transverse first outer diameter of said therapeutic roller surface to form supporting rollers surfaces adapted to separate the therapeutic roller surface from a surface upon which the hollow, therapeutic massage roller apparatus is intended to roll or rest when in use, each of said pair of cylindrical end caps further including a cylindrical outer cap shell having an opening, a container cap, and a rotatable locking plate having a plurality of snap fasteners and a plurality of locking tabs, wherein the rotatable locking plate is positioned within the opening of the cylindrical outer cap shell, and the rotatable locking plate is configured to rotate relative to the cylindrical outer cap shell, the plurality of snap fasteners of the rotatable locking plate are configured to engage the container cap, and the plurality of locking tabs of the rotatable locking plate on each pair of cylindrical end caps are configured to engage with the plurality of notches.

2. A massage foam roller apparatus, comprising:

at least two elongated massage pad modules having parallel, longitudinally extending side edges and being of semi-circular or partially circular transverse cross-section, each said elongated massage pad module having a rigid component and a resilient component, each said rigid component having a concave inner surface, a convex outer surface and alignment means integrally formed along each longitudinally extending side edge thereof, each said resilient component being affixed to and covering at least a substantial portion of the convex outer surface of a corresponding rigid component, said alignment means of each one of said rigid components being adapted to engage corresponding alignment means formed in the longitudinally extending side edges of a corresponding massage pad module of the at least two elongated massage pad modules to form an open ended, hollow cylindrical roller body with the resilient components thereof forming a therapeutic outer surface having a predetermined transverse outer diameter, said hollow cylindrical roller body including a first end and a second end opposite to the first end, wherein each of the first and second ends includes a plurality of notches; and a pair of cylindrical end caps open on one axial end thereof and adapted to receive and lockingly mate with and form closures for respective ends of said opened ended, hollow cylindrical roller body, the pair of cylindrical end caps including cylindrical outer cap shells with annular side skirts having an outside diameter greater than that of the predetermined transverse outer diameter of said hollow cylindrical roller body, said annular side skirts forming supporting end and user load bearing surfaces for elevating the therapeutic outer surface of the hollow cylindrical roller body above a surface upon which the massage foam roller apparatus is intended to roll or rest when in use, wherein each of said cylindrical outer cap shells having an opening, a container cap, and a rotatable locking plate having a plurality of snap fasteners and a plurality of locking tabs, wherein the rotatable locking plate is positioned within the opening of the cylindrical outer cap shell, and the rotatable locking plate is configured to rotate relative to the cylindrical outer cap shell, the plurality of snap fasteners of the rotatable locking plate are configured to engage the container cap, and the plurality of locking tabs of the rotatable locking plate on each pair of cylindrical end caps are configured to engage with the plurality of notches.

* * * * *